US010476202B2

(12) United States Patent
Lybrand

(10) Patent No.: US 10,476,202 B2
(45) **Date of Patent: *Nov. 12, 2019**

(54) WIRE-TO-WIRE CONNECTOR WITH INSULATION DISPLACEMENT CONNECTION CONTACT FOR INTEGRAL STRAIN RELIEF

(71) Applicant: AVX Corporation, Fountain Inn, SC (US)

(72) Inventor: Brent Lybrand, Fountain Inn, SC (US)

(73) Assignee: AVX CORPORATION, Fountain Inn, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/184,665

(22) Filed: Nov. 8, 2018

(65) Prior Publication Data

US 2019/0148878 A1 May 16, 2019

Related U.S. Application Data

(60) Provisional application No. 62/586,601, filed on Nov. 15, 2017.

(51) Int. Cl.

| | |
|---|---|
| ***H01R 11/20*** | (2006.01) |
| ***H01R 4/24*** | (2018.01) |
| ***H01R 13/58*** | (2006.01) |
| ***H01R 4/2406*** | (2018.01) |
| ***H01R 13/516*** | (2006.01) |
| ***H01R 4/22*** | (2006.01) |
| ***H01R 13/11*** | (2006.01) |
| ***H01R 4/2433*** | (2018.01) |
| ***H01R 4/2445*** | (2018.01) |

(Continued)

(52) U.S. Cl.

CPC ..... *H01R 13/58* (2013.01); *H01R 4/22* (2013.01); *H01R 4/2406* (2018.01); *H01R 4/2433* (2013.01); *H01R 4/2445* (2013.01); *H01R 13/11* (2013.01); *H01R 13/516* (2013.01); *H01R 11/05* (2013.01); *H01R 13/582* (2013.01); *H01R 13/701* (2013.01)

(58) Field of Classification Search

CPC ..... H01R 4/245; H01R 29/00; H01R 31/08; H01R 4/2433; H01R 4/4845

See application file for complete search history.

(56) References Cited

U.S. PATENT DOCUMENTS 5,435,747 A 7/1995 Franckx et al.
5,551,889 A 9/1996 Kozel et al.

(Continued)

OTHER PUBLICATIONS

International Search Report and Written Opinion on PCT/IB2018/058794 dated Feb. 22, 2019 (10 pages).

*Primary Examiner* — Xuong M Chung Trans

(74) *Attorney, Agent, or Firm* — Foley & Lardner LLP

(57) ABSTRACT

An apparatus includes a first electrical contact comprising a first aperture and a first insulation displacement opening. Centers of the first aperture and the first insulation displacement opening are aligned. The apparatus also includes an insulated housing comprising a first wire opening, a second wire opening, and a first electrical contact inlet extending through the first and second wire openings. The first electrical contact is at least partially inserted into the first electrical contact inlet such that at least a portion of the first aperture is aligned with the first wire opening.

23 Claims, 15 Drawing Sheets

(51) Int. Cl.
*H01R 11/05* (2006.01)
*H01R 13/70* (2006.01)

(56) References Cited

U.S. PATENT DOCUMENTS

| | | | | |
|---|---|---|---|---|
| 6,050,845 | A * | 4/2000 | Smalley, Jr. | H01R 4/2433 439/395 |
| 8,267,715 | B2 * | 9/2012 | Roosdorp | H01R 4/2425 439/404 |
| 9,231,316 | B2 * | 1/2016 | Hemmi | H01R 4/242 |
| 9,899,754 | B2 * | 2/2018 | Winheim | H01R 4/2425 |
| 2008/0108341 | A1 | 5/2008 | Baard | |
| 2011/0059632 | A1 | 3/2011 | Bishop | |
| 2012/0003850 | A1 | 1/2012 | Bishop et al. | |

* cited by examiner

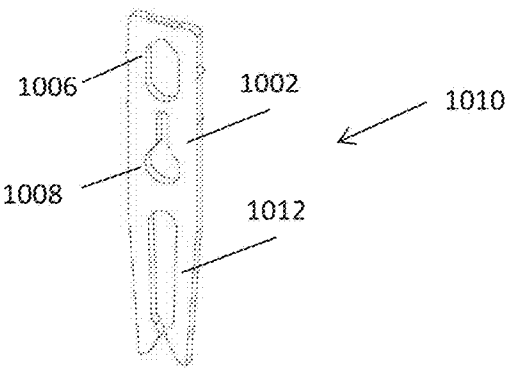
Figure 10a
Figure 10b
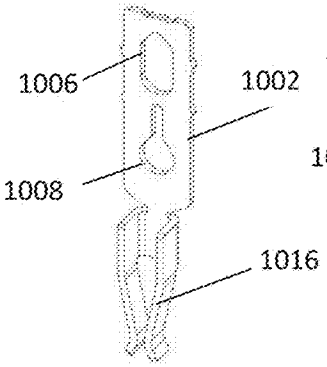
Figure 10c
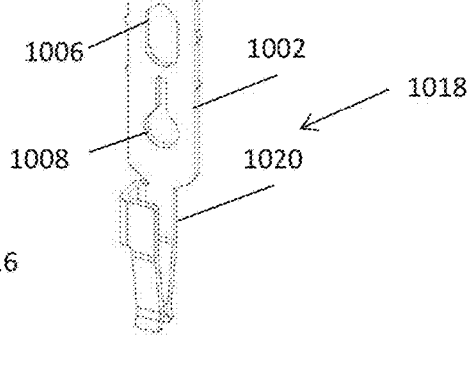
Figure 10d

WIRE-TO-WIRE CONNECTOR WITH INSULATION DISPLACEMENT CONNECTION CONTACT FOR INTEGRAL STRAIN RELIEF

CROSS-REFERENCE TO RELATED APPLICATIONS

The present application claims priority to U.S. Provisional Patent Application No. 62/586,601, filed Nov. 15, 2017, which is incorporated by reference herein in its entirety.

FIELD

The present application relates generally to the field of electrical connectors, and more particularly to a type of connector used to connect an insulated wire to another insulated wire.

BACKGROUND

The following description is provided to assist the understanding of the reader. None of the information provided or references cited are admitted to be prior art.

Various types of connectors are used for forming connections between an insulated wire and any manner of electronic or electrical component. These connectors are typically available as sockets, plugs, and shrouded headers in a vast range of sizes, pitches, and plating options. Traditionally, for two wires to be connected together, a user must strip the first and second wires, twist the two ends together, and then secure them to one other. This process can be tedious, inefficient, and undesirable. Furthermore, a wire-to-wire connection that may fall apart or short out unexpectedly could be hazardous or even deadly, especially in dangerous applications (e.g., the use of explosives in a mining operation). Thus, a quick, efficient, and reliable means of connecting and disconnecting wires is needed.

SUMMARY

The systems, methods and devices of this disclosure each have several innovative aspects, no single one of which is solely responsible for the desirable attributes disclosed herein.

An apparatus includes a first electrical contact having a first wire receiving portion. The first wire receiving portion includes a first insulation displacement connection (IDC) slot and a first strain relief slot displaced from the first IDC slot. The apparatus also includes a second electrical contact having a second wire receiving portion. The second wire receiving portion includes a second IDC slot and a second strain relief slot displaced from the second IDC slot. The apparatus further includes an insulated housing including a first electrical contact inlet, a second electrical contact inlet, a first plurality of wire openings, and a second plurality of wire openings. In some embodiments, the insulated housing includes a plurality of curved surfaces disposed between the first plurality of wire openings and the second plurality of wire openings.

In an embodiment, the apparatus also includes an electrical shunt. The electrical shunt includes a male contact prong received within a shunt opening of the insulated housing. The shunt opening is disposed between the first and second electrical contact inlets. In this embodiment, the first electrical contact further includes a first shunt connector portion and the second electrical contact further comprising a second shunt connector portion. In an embodiment, the first shunt connector portion and the second shunt connector portion each include respective female contact sockets adapted to receive and form an electrically-conductive connection with the male contact prong.

In some embodiments, the first and second IDC slots are substantially Y-shaped and extend from outer edges of the first and second wire receiving portions so as to form tapered distal end portions at the outer edges. In some embodiments, the first and second strain relief slots include distal portions and proximal portions. The proximal portions are of a first average width and the distal portions are of a second average width, the first average width less than the second average width.

In some embodiments, the first electrical contact further includes a third wire receiving portion and the second electrical contact further comprises a fourth wire receiving portion, the third wire receiving portion including a third IDC slot and a third strain relief slot, the fourth wire receiving portion including a fourth IDC slot and a fourth strain relief slot.

An apparatus includes a first electrical contact including a first aperture and a first insulation displacement opening. Centers of the first aperture and the first insulation displacement opening are aligned. The apparatus also includes an insulated housing comprising a first wire opening, a second wire opening, and a first electrical contact inlet extending through the first and second wire openings. The first electrical contact is at least partially inserted into the first electrical contact inlet such that at least a portion of the first aperture is aligned with the first wire opening. In some embodiments, the electrical contact is completely inserted into the electrical contact inlet such that a narrow portion of the first insulation displacement opening is aligned with the second wire opening. In an embodiment, the first insulation displacement opening is substantially Y-shaped and includes a wider portion extending from an edge of the first electrical contact.

In some embodiments, the insulated housing further includes a base and a cap disposed over an outer surface of the base. In such embodiments, the outer surface of the bases comprises a curved portion on a first side of the insulated housing extending between the first and second wire openings. The cap includes an elongated opening on the first side and a shorter opening on a second side of the insulated housing. Ends of the elongated opening are substantially aligned with outer edges of the first and second wire openings such that the elongated opening extends over the first and second wire openings. In some embodiments, the cap includes a first wire receiving tab and a second wire receiving tab extending from a surface, the first wire receiving tab on the first side and the second wire receiving tab on the second side. The first and second wire receiving tabs include latching prongs that are interlocked with ridges in the base.

In some embodiments, the electrical contact further includes a plurality of additional apertures and a plurality of additional insulation displacement openings. In such embodiments, the insulated housing further comprises plurality of additional wire openings, wherein the first electrical contact inlet extends through the plurality of additional wire openings. A set of the plurality of additional wire openings are at least aligned with portions of the plurality of additional apertures.

In some embodiments, the apparatus further includes a second electrical contact having a second aperture and a second insulation displacement opening. In such embodiments, the insulated housing further includes a third wire opening, a fourth wire opening, and a second electrical contact inlet extending through the third and fourth wire openings. The second electrical contact is at least partially inserted into the second electrical contact inlet such that a portion of the second aperture is aligned with the third wire opening. In some embodiments, the first and second electrical contact inlets are disposed on opposing sides of a central axis of the insulated housing.

A method includes partially inserting an electrical contact into an inlet of an insulated housing, inserting a first wire into a first through-hole on a first side of the insulated housing, inserting the first wire into a second through-hole on the second side of the insulated housing. The second through-hole is displaced from the first through-hole in a direction perpendicular to a direction of extension of the first through-hole. The method also includes compressing the electrical contact into the inlet such that a narrow portion of an insulation displacement opening of the electrical contact displaces removes insulation on the first wire to create an electrical connection between the electrical contact and the first wire and an aperture of the electrical contact compresses insulation of the first wire to create a point of contact between the electrical contact and the first wire.

In some embodiments, after inserting the first wire into the first through-hole but prior to compressing the electrical contact into the inlet, the first wire is wrapped around an inner surface of the insulated housing so as direct an end of the first wire into the second through-hole.

In some embodiments, prior to compressing the electrical contact into the inlet, the method includes inserting a second wire into a third through-hole on the first side of the insulated housing and inserting the second wire into a fourth through-hole on the second side of the insulated housing.

In some embodiments, the inlet is a first inlet and the electrical contact is a first electrical contact. In such embodiments, the method further includes partially inserting a second electrical contact into a second inlet of the insulated housing, inserting a second wire into a third through-hole on the first side of the insulated housing, inserting the second wire into a fourth through-hole on the second side of the insulated housing, and compressing the second electrical contact completely into the second inlet such an edge of an insulation displacement opening of the second electrical contact displaces insulation on the second wire to create an electrical connection between the second electrical contact and the second wire, and an aperture of the second electrical contact compresses insulation of the second wire to create a point of contact between the second electrical contact and the second wire.

In some embodiments, the method further includes inserting a male contact prong into a shunt opening of the insulated housing such that the male contact prong engages a first shunt connector portion of the first electrical contact and a second shunt connector portion of the second electrical contact to conductively couple the first electrical contact to the second electrical contact. In some embodiments, the method includes removing the male contact prong from the shunt opening of the insulated housing such that the male contact prong disengages the first shunt connector portion of the first electrical contact and the second shunt connector portion of the second electrical contact to conductively decouple the first electrical contact from the second electrical contact.

BRIEF DESCRIPTION OF THE DRAWINGS

FIGS. 10*a*, 10*b*, 10*c*, and 10*d* depict isometric views of electrical contacts of wire-to-wire connectors in accordance with various illustrative embodiments.

DETAILED DESCRIPTION

Figure 1A:
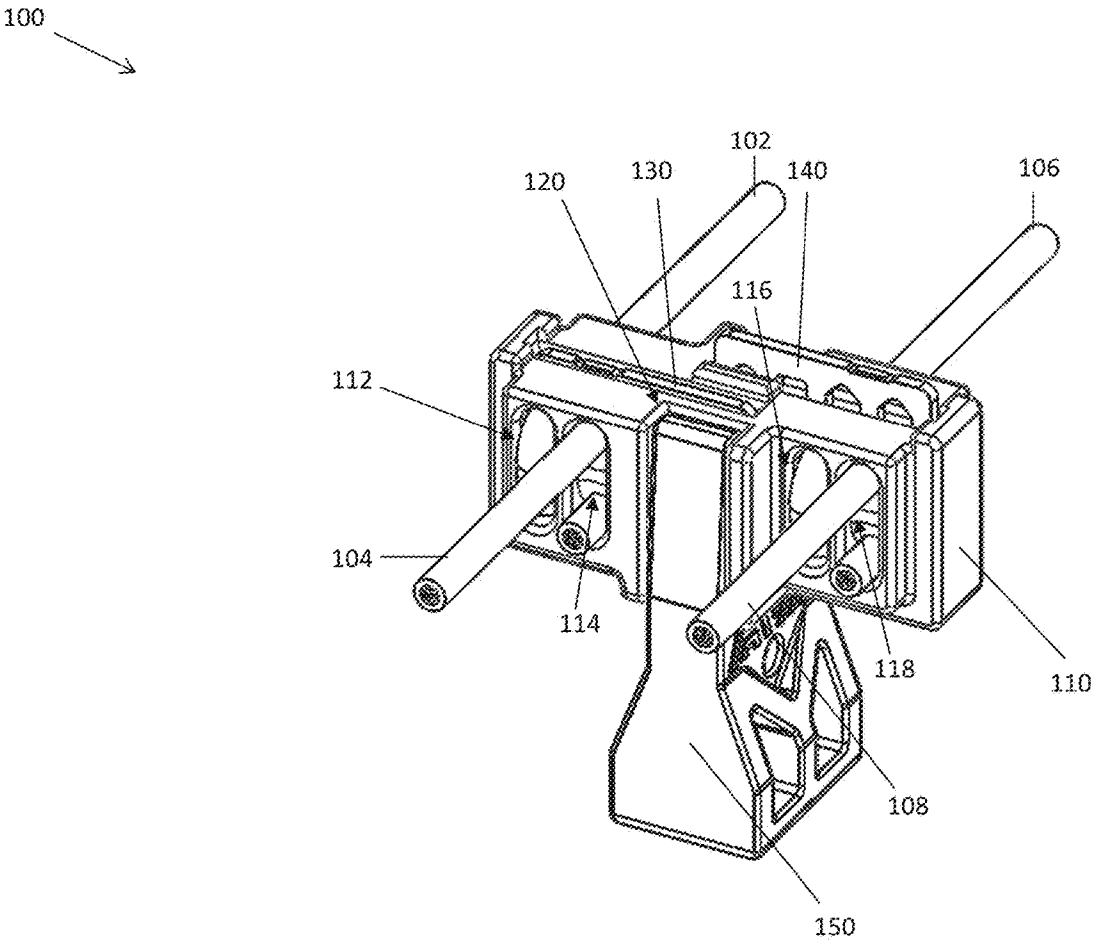
FIG. 1*a* depicts an isometric view of a wire-to-wire connector with wires installed in accordance with an illustrative embodiment.

Reference will now be made to various embodiments, one or more examples of which are illustrated in the figures. The embodiments are provided by way of explanation of the invention, and are not meant as a limitation of the invention. For example, features illustrated or described as part of one embodiment may be used with another embodiment to yield still a further embodiment. It is intended that the present application encompass these and other modifications and variations as come within the scope and spirit of the invention.

Disclosed herein is a wire-to-wire connector that includes an insulated housing including an inlet (e.g., port, slot, cavity, etc.) for an electrical contact. The electrical contact includes at least one wire aperture and at least one insulation displacement opening. The insulation displacement opening is configured to form an insulation displacement connection at a first point in a wire and the aperture provides an additional point of contact at a second point of the wire to relieve stress from the first point. Such a wire-to-wire connector allows for an efficient and rapid creation of an electrical and mechanical connection between the conductive element of an insulated wire and an electrical contact of the connector. Further, the insulated housing assists in the electrical and mechanical connection between the electrical contact and the insulated wire, and ensures that the electrical contact is secured in an electrically insulated location.

According to various embodiments, the wire-to-wire connector disclosed herein enables efficient and rapid creation of an electrical connection between at least two wires. For example, in one embodiment, the electrical contact includes at least one additional aperture and insulation displacement opening configured to form an insulation displacement connection at a first point in an additional wire. The additional aperture that provides an additional point of contact at the second point of the additional wire to relieve stress from the first point. As described herein, via such an electrical contact multiple wires may be securely connected with one another via the combination of the electrical contact and insulated housing.

In some embodiments, the wire-to-wire connector further includes a shunt. The shunt allows for a selective electrical connection or disconnection between two or more electrical connectors (e.g., each including an associated insulated housing and electrical contact), thus facilitating the connection of one or more electrical wires. The unique design of the wire-to-wire connector disclosed herein ensures that two or more wires can be efficiently, safely, and reliably connected to and disconnected from live electrical components with minimal human intervention. That is, the wire-to-wire connector ensures that the wires that are engaged with the wire-to-wire connector will not fall apart by providing two points of contact between each wire and the wire-to-wire connector. Specifically, the wire wraps through two different through-holes (e.g., aligned with the aperture and insulation displacement opening in the electrical contact), where one of the through-holes provides retention support to the wire as its insulation is displaced and an electrical connection is made between the conductive core of the wire and an electrical contact (e.g., at the first point), and the other through-hole provides retention support to the wire as the second aperture of the electrical contact pinches (i.e., compresses) the wire's insulation to mechanically secure the wire (e.g., second point of contact). Furthermore, the wire-to-wire connector allows for more than two wires to be electrically connected to each other, which is beneficial in a system that requires many components to be coupled to a control device or wire. In an example embodiment, the wire-to-wire connector discussed herein allows for many explosives at a mining site to be efficiently networked together and safely and reliably controlled.

Various embodiments of a wire-to-wire connector with shunt are illustrated throughout FIGS. 1 through 13. The wire-to-wire connector disclosed in these figures is configured to connect a conductive core of an insulated wire with an electrical contact. In an embodiment, the electrical contact connects to a plurality (e.g., two, three, four, etc.) of electrical wires and is disposed within an inlet of an insulated housing. Furthermore, the insulated housing may house one, two, or more electrical contacts. In some embodiments, the electrical contact is mechanically and electrically shunted to at least one additional electrical contact. It should be appreciated that the wire-to-wire connectors disclosed herein are not limited by a maximum number of wire positions, electrical contacts, shunts, or types of connections that couple each component together.

Figure 1B:
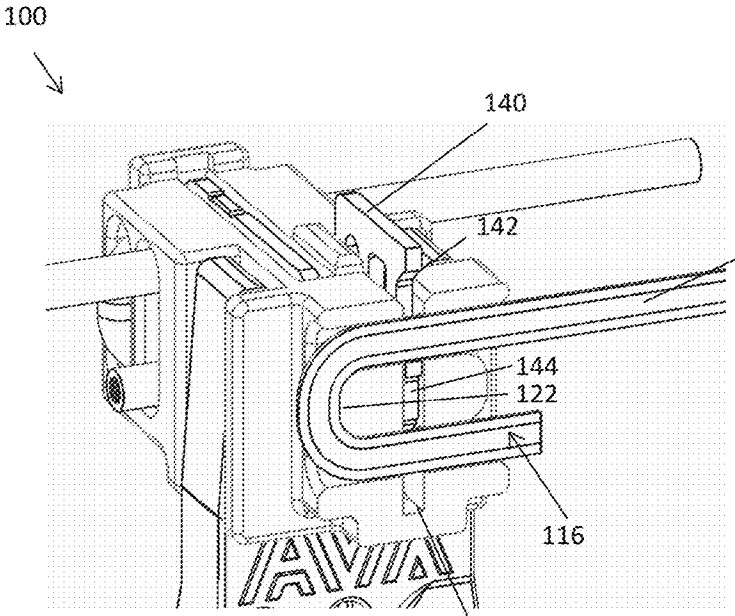
FIGS. 1*b* and 1*c* depict cross sectional views of a wire-to-wire connector with wires installed in accordance with an illustrative embodiment.
Figure 1C:
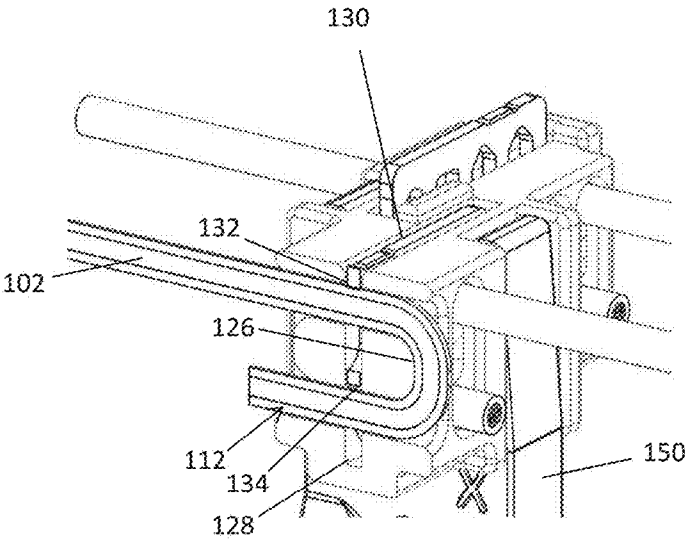

Referring to FIGS. 1*a*, 1*b*, and 1*c* in general, a wire-to-wire connector 100 with a shunt 150 is depicted as four separable elements in accordance with various illustrative embodiments. FIG. 1*a* depicts an isometric view of a wire-to-wire connector 100 in accordance with an illustrative embodiment. FIG. 1*b* depicts a cross-sectional view of the wire-to-wire connector 100 in accordance with an illustrative embodiment. FIG. 1*c* depicts cross-sectional view of a wire-to-wire connector 100 in accordance with an illustrative embodiment. As generally depicted in FIGS. 1*a*, 1*b*, and 1*c*, the wire-to-wire connector 100 includes a first electrical contact 130, a second electrical contact 140, an insulated housing 110, and an electrical shunt 150. Each of the two electrical contacts 130 and 140 include a shunt connector portion and a wire receiving portion and are discussed in further detail in FIG. 2*a*. In alternative embodiments, the wire-to-wire connector 100 may be compatible with two, three, four, or more electrical contacts such that the wire-to-wire connector 100 is able to form electrical connections with any number of wires.

Referring generally to FIG. 1*a*, the insulated housing 110 includes a first pair of wire openings 112, a second pair of wire openings 114, a third pair of wire openings 116, and a fourth pair of wire openings 118. Each of the first, second, third, and fourth pairs of wire openings 112, 114, 116, and 118 includes a first wire opening (e.g., an upper wire opening) and a second wire opening (e.g., a lower wire opening). The first and second wire openings are aligned with apertures in the first and second electrical contacts 130 and 140 such that each of the first, second, third, and fourth pairs of wire openings 112, 114, 116, and 118 is configured to receive a respective wire 102, 104, 106, and 108. For example, the wire 104 is disposed through a first wire opening of the first pair of wire openings 112, wraps around an inner surface of the insulated housing 110, and back through the second wire opening of the first pair of wire openings 112. It should be appreciated that, in various alternative embodiments, any of the wires 102, 104, 106, and 108 may be inserted into the second through holes of the first, second, third, and fourth pairs of wire openings 112, 114, 116, and 118, wrapped around the insulated housing 110, and then routed through the first through holes of the first, second, third, and fourth pairs of wire openings 112, 114, 116, and 118. As described herein, the wrap-around attachment of the wires 102, 104, 106, and 108 to the insulated housing 110 facilitates a secure and reliable electrical connection to be formed, for example, between the wires 102 and 104 and the first electrical contact 130.

In the example shown, each wire opening in the first, second, third, and fourth pairs of wire openings 112, 114, 116, and 118 are rectangular-shaped with rounded edges. It is to be appreciated that the wire-to-wire connector 100, or any of the features thereof, may be sized or shaped to facilitate use with any type or size of wire. Furthermore, a wire may be inserted into the wire-to-wire connector 100 from either side of the wire-to-wire connector 100.

Still referring to FIG. 1*a*, the wires 102 and 104 are electrically coupled to the first electrical contact 130 that is entirely inserted into an electrical contact inlet of the insulated housing 110. As such, the first electrical contact 130 is conductively coupled to the electrical shunt 150. Additionally, the wires 106 and 108 are inserted through apertures in the second electrical contact 140. In the configuration shown, the second electrical contact 140 is partially inserted into a respective contact inlet of the insulated housing 110. As will become apparent from the present disclosure, in such a configuration, the second electrical contact 130 is not electrically connected to the wires 106 and 108. To form such a connection, one need only to compress the second electrical contact 140 into an electrical contact inlet of the insulated housing 110. Once this connection is made, the wires 102, 104, 106, and 108 will be electrically connected to one another. In an embodiment, the insulated housing 110 includes a shunt receiving portion 120 having surfaces corresponding to latching prongs of the electrical shunt 150 to facilitate a secure connection.

As shown in FIG. 1*b*, the wire 106 is inserted through a first through hole in the third pair of through holes 116 and an aperture 142 of the second electrical contact 140. The wire 106 wraps against an inner surface 122 of the insulated housing (e.g., separating the first and second wire openings of the third pair of wire openings 116) and extends back through a second wire opening in the third pair of through holes 116. Since the second electrical contact 140 is only partially inserted into an electrical contact inlet 124, the wire 106 only extends through part of an insulation displacement opening 144 of the second electrical contact 140. As described herein, the insulation displacement opening 144 includes a narrow region that displaces an insulation layer on the wire 106 when the second electrical contact 140 is completely inserted into the electrical contact inlet 124.

As shown in FIG. 1*c*, the wire 102 is inserted through a first through hole in the first pair of wire openings 112 and an aperture 132 of the first electrical contact 130. The wire 102 wraps against an inner surface 126 of the insulated housing (e.g., separating the first and second wire openings of the first pair of wire openings 112) and extends back through a second wire opening in the first pair of through wire openings 112. Since the first electrical contact 130 completely inserted into an electrical contact inlet 124, a narrow portion of an insulation displacement opening 134 of the first electrical contact 130 displaces an insulation layer on the wire 102 to form a conductive connection between the wire 102 and first electrical contact 130. Additionally, a surface of the aperture 132 presses against the insulating layer of the wire 102 to secure the wire in the first wire opening. As a result, less stress is placed at a point of contact between the wire 102 and the second wire receiving portion 134, which ensures a more reliable electrical connection. Additionally, a shunt receiving portion of the first contact 130 is conductively connected to a contact within the shunt 150.

Figures 2A, 2B, 2C:
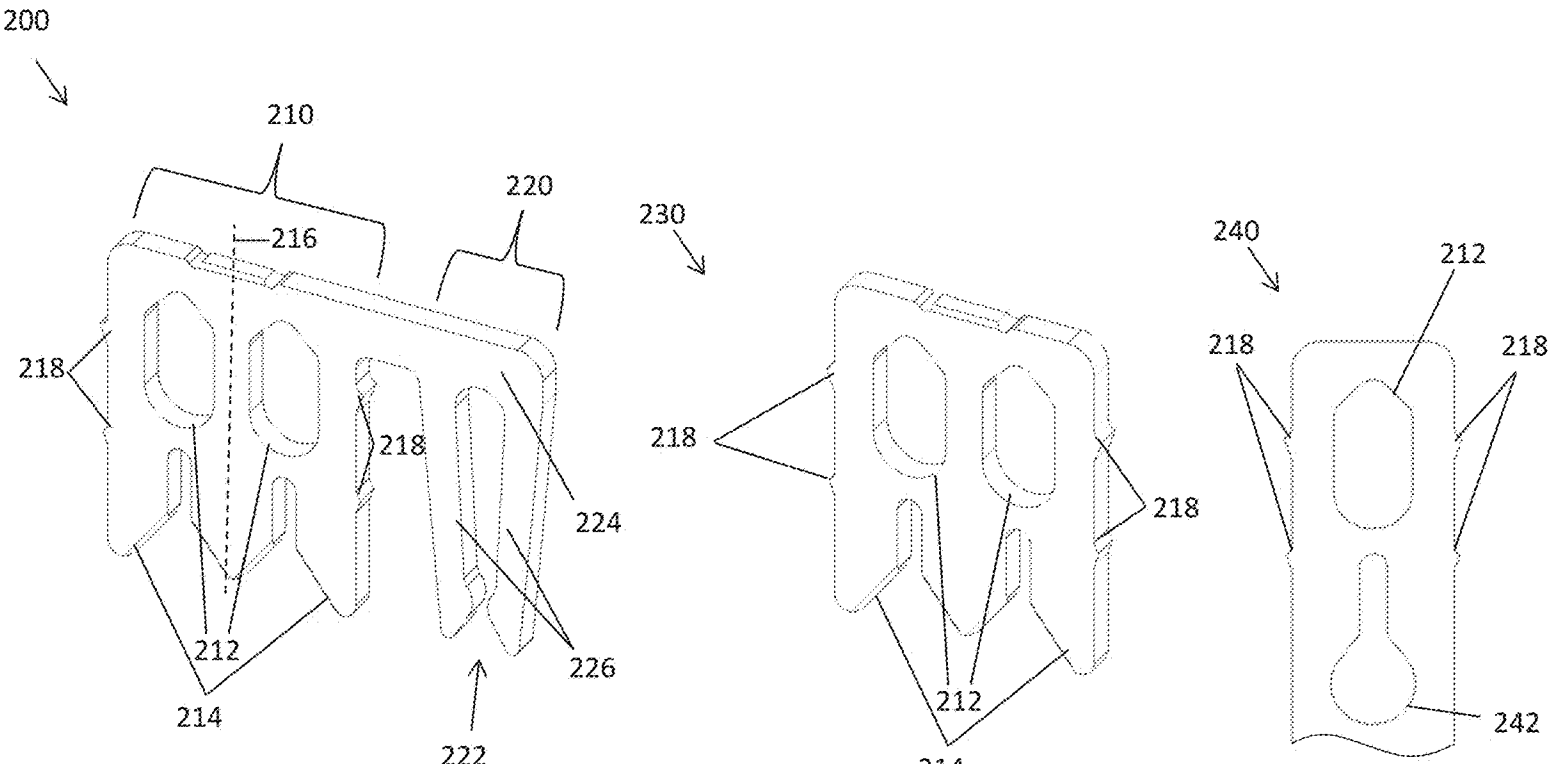
FIG. 2*a* depicts an isometric view of an electrical contact in accordance with an illustrative embodiment.
FIG. 2*b* depicts an isometric view of an electrical contact in accordance with an illustrative embodiment.
FIG. 2*c* depicts an isometric view of an electrical contact in accordance with an illustrative embodiment.

FIG. 2*a* depicts an isometric view of an electrical contact 200 in accordance with an illustrative embodiment. The electrical contact 200 of FIG. 2*a* includes a wire receiving portion 210 and a shunt connector portion 220. The shunt connector portion 220 includes a female contact socket 222 and a base 224. The female contact socket 222 includes two contact tines 226 that are co-planar with the base 224. The contact tines 226 are angled with respect to one another such that a gap between them decreases with distance from the base 224 until two ridges extend toward one another proximate to ends of the contact tines 226. The ridges may be half-circular, rectangular, triangular, or any other polygonal shape. The distance between the contact tines 226 at the ridges ensures that the contact tines 226 will compress the electrical shunt when inserted into the female socket 222.

In alternative embodiments, the female contact socket 222 may include more or less than two contact tines. For example, the female contact socket 222 may be a singular socket-shaped tine, or it may include three, four, or more contact tines. Preferably, the female contact socket 222 is adapted such that it can receive and secure a prong from an electrical shunt to create an electrical connection. The contact tines 226 may also have different shapes. For example, the contact tines 226 may be tapered such that the width of the tine is larger at the top and decreases as the contact tines 226 extend away from the base 224.

Still referring to FIG. 2*a*, the wire receiving portion 210 includes apertures 212 and insulation displacement openings 214. In the example shown, there are two insulation displacement openings 214 extending from a first (e.g., lower) edge of the electrical contact 200. The insulation displacement openings 214 are substantially Y-shaped with angular portions extending from the outer edge and narrower stems extending from apexes of the angular portions. The angular portions extend from a point at an axis 216 (e.g., a central axis) of the wire receiving portion 210 such that a lower portion of the wire receiving portion 210 includes an outer blade, a central blade, and an inner blade. The outer, inner, and central blades are tapered. Such a configuration facilities guiding wires inserted in the insulation displacement openings 214 to the stems as the electrical contact 200 is pressed downward.

Edges of the wire receiving portion 210 include juts 218 (e.g., points, ridges, etc.) extending therefrom. In some embodiments, juts 218 are vertically positioned along the second and third edges to facilitate the proper insertion of the electrical contact 200 into an insulated housing. In an embodiment, a first set of the juts 218 (e.g., the pair of juts 218 on either side of the wire receiving portion 210 that are nearest the lower edge) fits into a corresponding set of grooves in an insulated housing to stably position the electrical contact 200 in a partially inserted position (e.g., as described with respect to the second electrical contact 140 described with respect to FIG. 1). The apertures 212 include elongated rounded portions and v-shaped portions proximate to the upper edge of the wire receiving portion 210. When the electrical contact is in the partially-inserted position, the elongated rounded portions of the apertures are aligned with a first set of first wire openings in the insulated housing. Additionally, the angular potions of the insulation displacement openings 214 are aligned with a second set of wire openings in the insulated housing. Thus, wires may be inserted through the wire openings and the electrical contact 200 prior to completion of the insertion into the insulated housing. As such, the elongated shape of the apertures 212 allows for freedom of movement of the electrical contact 200 during the installation of the wire. For example, corresponding wires can be easily inserted through the lower portion of the wire apertures 212, then the electrical contact 200 can be compressed into its corresponding wire contact inlet and the wire can moved towards the v-shaped portions such that the apertures 212 compress (i.e., pinch) the insulation of the wire and mechanically secure the wire within the insulated housing. Additionally, other portions of the wires may be forced into the narrower stems of the insulation displacement openings 214 so as to cause localized displacement of insulating layers on the wires to form an electrical connection.

FIG. 2*b* depicts an isometric view of an electrical contact 230 in accordance with an illustrative embodiment. In various embodiments, the electrical contact 230 is similar in structure to the electrical contact 200 described with respect to FIG. 2*a* except that the electrical contact 230 does not include the shunt connector portion 220. In other words, the electrical contact 230 includes only the wire receiving portion 210 described above. As such, common reference numerals are used in FIG. 2*b* to describe the incorporation of similar elements described above with respect to FIG. 2*a*. Such an electrical contact may be used, for example, in an embodiment where the wire-to-wire connector does not include a shunt. It should be noted that in various embodiments, the insulation displacement openings 214 of the electrical contact are differently shaped. For example, in one alternative embodiment, the insulation displacement openings 214 are displaced from outer edges of the electrical contact 230 and include wider lower openings with slits extending therefrom (e.g., as depicted in the electrical contacts described with respect to FIGS. 10*a*, 10*b*, 10*c*, and 10*d*). Additionally, in various alternative embodiments, the electrical contact 230 includes more than two sets of apertures 212 and insulation displacement openings 214. For example, in one embodiment, the electrical contact includes three sets of apertures 212 and insulation displacement openings 214.

FIG. 2*c* depicts an isometric view of an electrical contact 240 in accordance with an illustrative embodiment. As shown, the electrical contact 240 includes a single aperture 212 and a single insulation displacement opening 242. As such, the electrical contact 240 is configured to hold only a single wire. Additionally, the insulation displacement opening 242 is offset from the lower edge of the electrical contact 240. The insulation displacement opening 242 includes a lower circular portion and an upper slit configured to displace an insulating layer from a wire disposed therein.

Figure 3B:
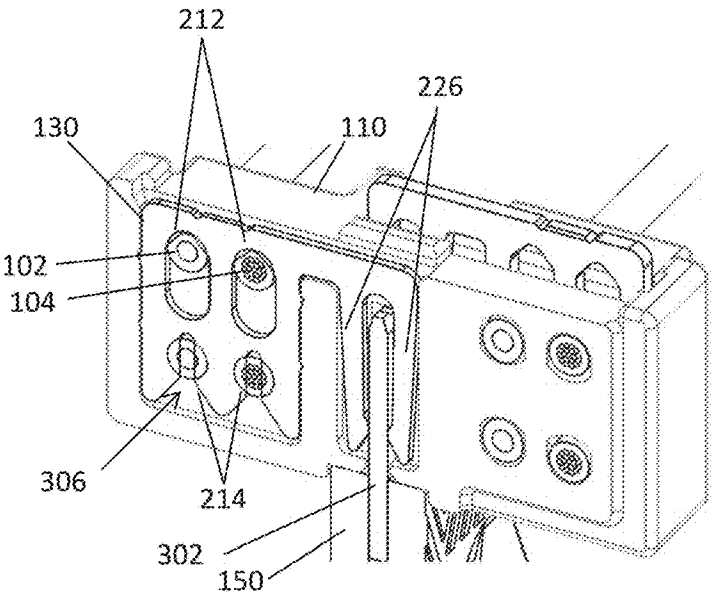
FIGS. 3*a* and 3*b* depict cross-sectional views of a wire-to-tire connector in accordance with an illustrative embodiment.
Figure 3A:
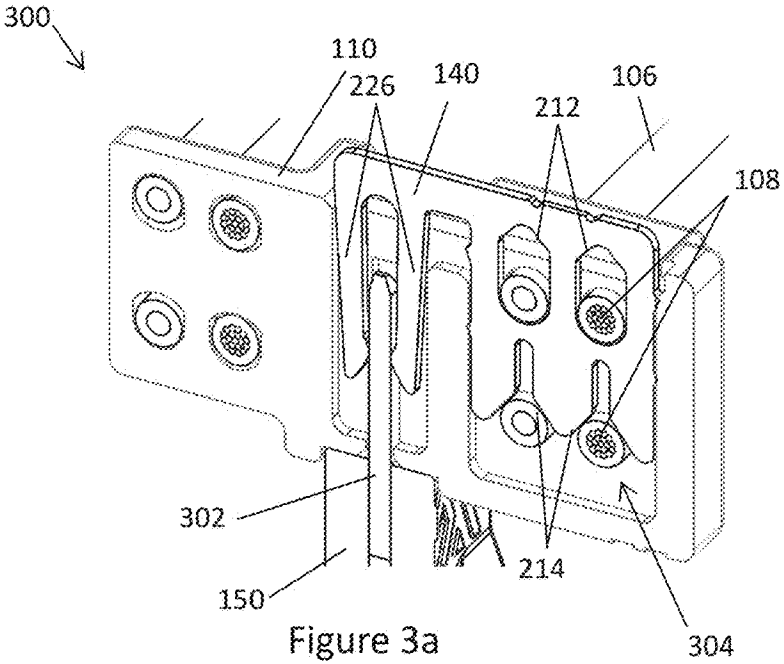

FIGS. 3*a* and 3*b* depict cross-sectional views of a wire-to-wire connector 300 in accordance with an illustrative embodiment. In the example shown, the wire-to-wire connector 300 is similar to the wire-to-wire connector 100 described with respect to FIGS. 1*a*, 1*b*, and 1*c*, where the first and second electrical contacts 130 and 140 are embodied as the electrical contact 200 described with respect to FIG. 2*a*. Accordingly, FIGS. 3*a* and 3*b* incorporate reference numerals described with respect to FIGS. 1*a*, 1*b*, 1*c*, and 2*a* to depict the incorporation of like components.

As shown in FIG. 3*a*, when the second electrical contact 140 is partially inserted into the insulated housing 110, edges of the apertures 212 are aligned with wire openings in the insulated housing 110. As such, the wires 106 and 108 extend through the elongated rounded portions of the apertures 212, around an inner surface of the insulated housing, and back through additional wire openings in the insulated housing 110 such that the wires extend through the angled portions of the insulation displacement openings 214. As shown, with the second electrical contact 140 positioned in this manner, there is room for the wires 106 and 108 to translate with respect to the electrical contact 200 as the electrical contact is pressed further into an electrical contact inlet 304. Also as shown, ridges of the contact tines 226 press against outer surfaces of an electrical contact 302 providing an electrical contact between the shunt 150 and the second electrical contact 140.

As shown in FIG. 3*b*, when the first electrical contact 130 is completely inserted into an electrical contact inlet 306 of the insulated housing 110 v-shaped portions of the apertures 212 press against insulating layers on the wires 102 and 104, thus securing the wires 102 and 104 to the insulated housing. Additionally, other contact points of the wires 102 and 104 are disposed in the narrower stems of the insulation displacement openings 214. As shown, the stems are of a dimension (e.g., width) that is less than the diameters of the wires 102 and 104. As a result, upon the first electrical contact 130 being removed from a partially-inserted position (e.g., as described with respect FIG. 1*a* and the second electrical contact 140) to a fully-inserted position, the edges of the insulation displacement openings 214 displace portions of outer insulating layers on the wires 102 and 104. As shown, the stems are of a lesser dimension than even inner conductive portions of the wires 102 and 104. Given this, when the outer insulating layers are displaced, the conductive portions of the wires 102 and 104 are placed in direct contact with the first electrical contact 130, thereby creating an electrical connection between the electrical contact and the wires 102 and 104. Additionally, since the v-shaped grooves of the apertures 212 apply force against additional points on the wires 102 and 104, stress is reduced at the insulation displacement openings 214, thereby ensuring a secure, reliable electrical connection between the wires 102 and 104 and the first electrical contact 130.

Additionally, ridges of the contact tines 226 of the first electrical contact 130 press against outer surfaces of the electrical contact 302 of the shunt 150. As a result, both the first and second electrical contacts 130 and 140 are electrically connected to the shunt 150. Given this, once the second electrical contact 140 is pressed into the fully-inserted position, each of the wires 102, 104, 106, and 108 will be electrically connected with one another.

Figure 4:
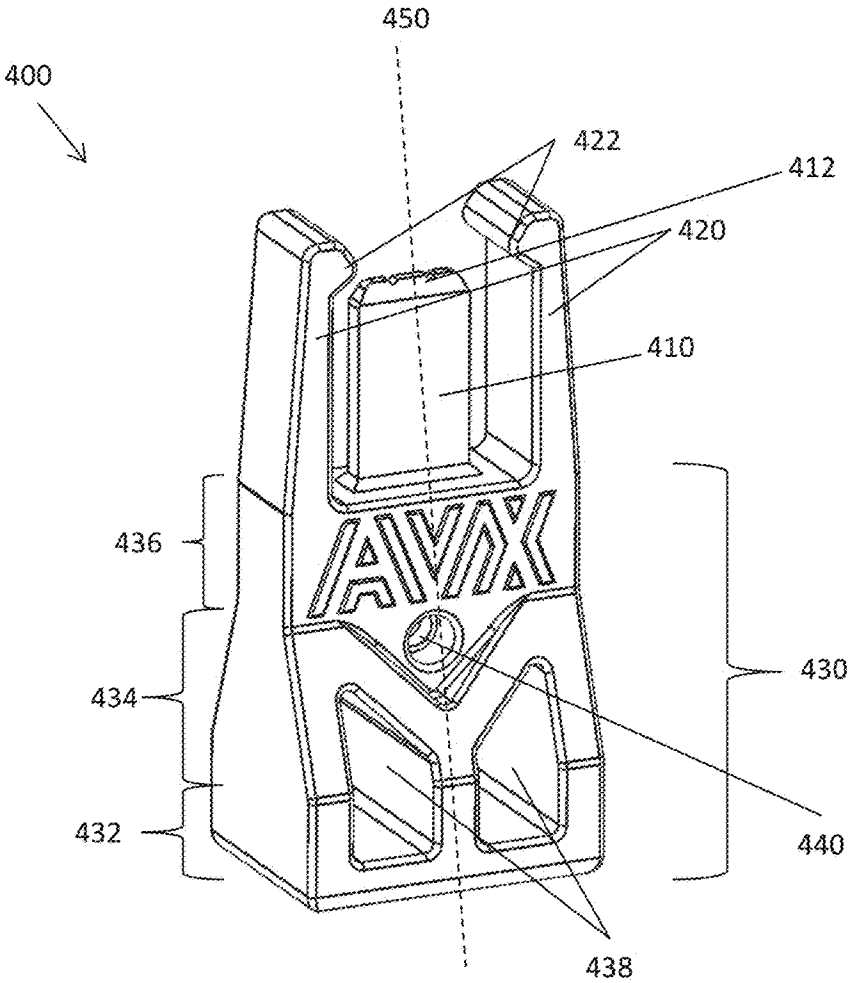
FIG. 4 depicts an isometric view of an electrical shunt of a wire-to-wire connector in accordance with an illustrative embodiment

FIG. 4 depicts an isometric view of an electrical shunt 400 in accordance with an illustrative embodiment. In an example, embodiment, the shunt 400 corresponds to the shunt 150 described with respect to FIGS. 1*a*, 1*b*, and 1*c*. The electrical shunt 400 includes a male contact prong 410, latching prongs 420, and a shunt molding 430. In an embodiment, the male contact prong 410 is substantially rectangular-shaped, and is conductive element that consists of a single piece of an electrically conductive material. In alternative embodiments, the male contact prong 410 may have alternative shapes and may include multiple conductive elements designed into any shape that allows the shunt to engage with two or more electrical contacts. The male contact prong 410 includes a tapered edge 412 at an end opposite to the shunt molding 430. The tapered edge 412 allows for the male contact prong 410 to be easily inserted into a corresponding female socket (e.g., of electrical contacts). The male contact prong 410 is mechanically connected to the shunt molding 430. For example, in some embodiments, a portion of the male contact prong 410 extends into an inlet within the shunt molding 430 and is secured to the shunt molding 430 via an adhesive.

In various embodiments, the shunt molding 430 is molded from a single piece of non-conductive material. In alternative embodiments, the shunt molding 430 may be multiple non-conductive sections are mechanically coupled together (e.g., via an adhesive, fasteners, etc.). In the example shown, the shunt molding 430 includes a base portion 432, a transition portion 434, and a connective portion 436. The base portion 432 provides a structural foundation for the electrical shunt 400 and, in some implementations, is coupled to a mounting surface. In the example shown, the base portion 432 is substantially parallelepiped-shaped and has a cross section area larger than the remainder of the electrical shunt 400 to provide structural support to an associated wire-to-wire connector.

In an embodiment, the transition portion 434 extends from an end of the base portion 432 and includes two tapered sides extending between the connective portion 436 and the base portion 432. As a result, a cross-sectional area of the transition portion 434 diminishes with distance from the base portion 432. In the example shown, openings 438 extend through the entirety of the shunt molding 430 through portions of the base portion 432 and the transition portion 434. The openings 438 facilitate the gripping of the electrical shunt 400 during the process of, for example attaching the electrical shunt 400 to an insulated housing of a wire to wire connector. Additionally, the shunt molding 430 further includes an aperture 440 extending through a portion of the transition portion proximate to a boundary between the transition portion 434 and the connective portion 436. In the example shown, the aperture is substantially circular, but may have different shapes in alternative embodiments. The aperture 440 may be used in order to tie or secure the electrical shunt to another object. For example, it may be beneficial in some applications to secure the electrical shunt to a plank, rock, vehicle, etc.

In the example shown, the connective potion 436 extends from the transition portion 434, and is substantially parallelepiped shaped, with a relatively constant cross-sectional area along a central axis 450 of the electrical shunt 400. The connective portion 436 may have different shapes in various alternative embodiments. In an embodiment, the latching prongs 420 extend from the connective portion 436 and are substantially parallel to the male contact prong 410. Knobs 422 are located at ends of the latching prongs 420 and extend toward the central axis 450. The knobs 422 facilitate securely connecting the electrical shunt 400 to, for example, a latching portion of an insulated housing of a wire-to-wire connector (e.g., a tapered locking edge). In some embodiments, the knobs 422 may be shaped as half-circles, rectangles, triangles, or any other polygonal shape that allow for the latching prongs 420 to mechanically secure the electrical shunt 400 to a corresponding device.

In the example shown, the latching prongs 420 extend a greater distance than the male contact prong 410 from the connective portion 436 to provide clearance for additional components of a wire-to-wire connector. In other words, a shorter dimension of the male contact prong 410 enables additional components (e.g., electrical contacts) of the wire-to-wire connector to engage with the male contact prong 410 and fit within a gap between the latching prongs 420. In some embodiments, the male contact prong 410 is centered within the electrical shunt 400 to facilitate the mounting of an insulated housing that is symmetrical along the central axis 450 thereto.

Figure 5B:
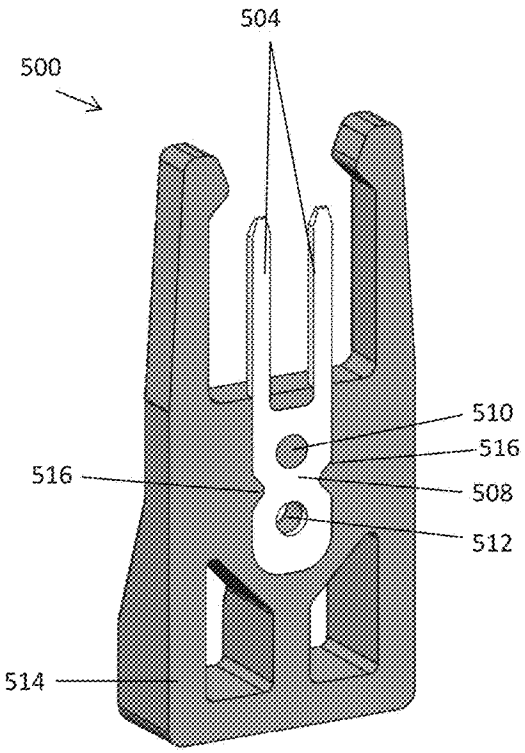
FIGS. 5*a* and 5*b* depict views of an electrical shunt of a wire-to-wire connector in accordance with an illustrative embodiment.
Figure 5A:
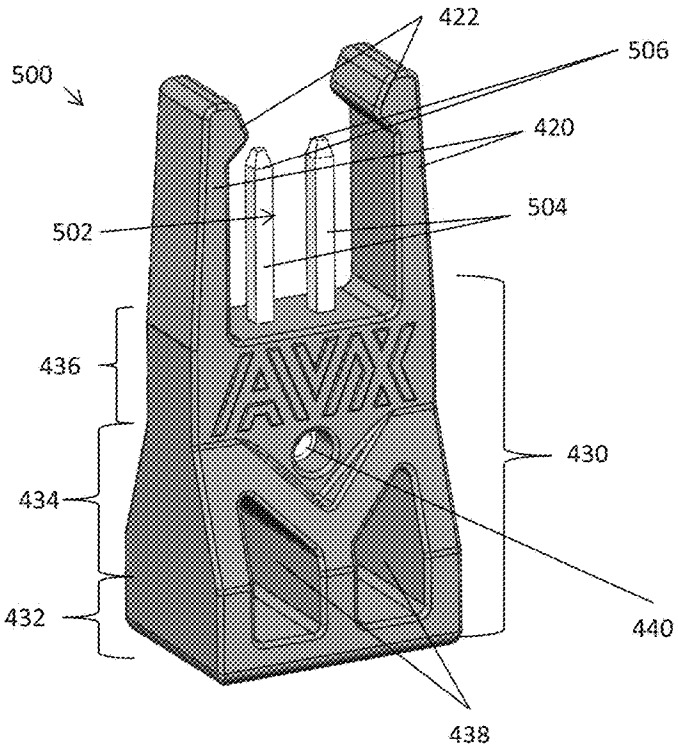

Referring to FIGS. 5*a* and 5*b* in general, views of an electrical shunt 500 are shown, according to an illustrated embodiment. FIG. 5*a* shows a perspective view of the electrical shunt 500 in according to an illustrative embodiment. FIG. 5*b* shows a cross-sectional view of the electrical shunt 500 in accordance with an illustrative embodiment. In various embodiments, the electrical shunt 500 may serve as an alternative to the electrical shunt 400 described with respect to FIG. 4. In the example shown, the electrical shunt 500 shares components with the electrical shunt 400. Accordingly like reference numerals are used in FIG. 5 to indicate the incorporation of such like components.

As shown in FIG. 5*a*, the electrical shunt 500 differs from the electrical shunt 400 in that, rather than including a singular male contact prong (e.g., the male contact prong 410 described with respect to FIG. 4), the electrical shunt 500 includes a pair of male contact prongs 502 extending from the connecting portion 436. In the example shown, the pair of male contact prongs 502 is substantially square-shaped and include tapered ends 506 to facilitate the coupling of each of the pair of male contact prongs 502 with portions of electrical contacts. The pair of male contact prongs 502 is symmetrically disposed about a central axis of the electrical shunt 500 to facilitate engagement with a symmetrical wire-to-wire connector.

As shown in FIG. 5*b*, the pair of male contact prongs 504 extends from a body 508 constructed of the same material as the pair of male contact prongs 504. The body 508 is disposed within an inner cavity defined by the shunt molding 430. For example, in one embodiment, the shunt molding 430 is constructed from a first half 514 and a second half (not depicted), where each of the first and second half includes a portion having an inner surface shaped to correspond to an outer surface of the body 508. In this embodiment, the body 508 is placed into the first half prior to the attachment of the second half such that the body 508 is disposed within the inner cavity defined by the portions of the first and second halves. The body 508 includes a first aperture 510 and a second aperture 512. The first aperture 510 is shaped to receive a protruding portion of the first half. Since the first aperture 510 engages with the protruding portion, the body 508 is securely fixed within the cavity. The second aperture 512 is aligned with the aperture 440 in the shunt molding 430 to facilitate utilization of the aperture 440 in, for example, tying the electrical shunt 400 to external entities. Additionally, the body 508 includes grooves 516 disposed on outer edges thereof. The grooves 516 engage with extensions defining the cavity within the shunt molding 430 to prevent movement of the body 508 within the cavity.

Figure 6:
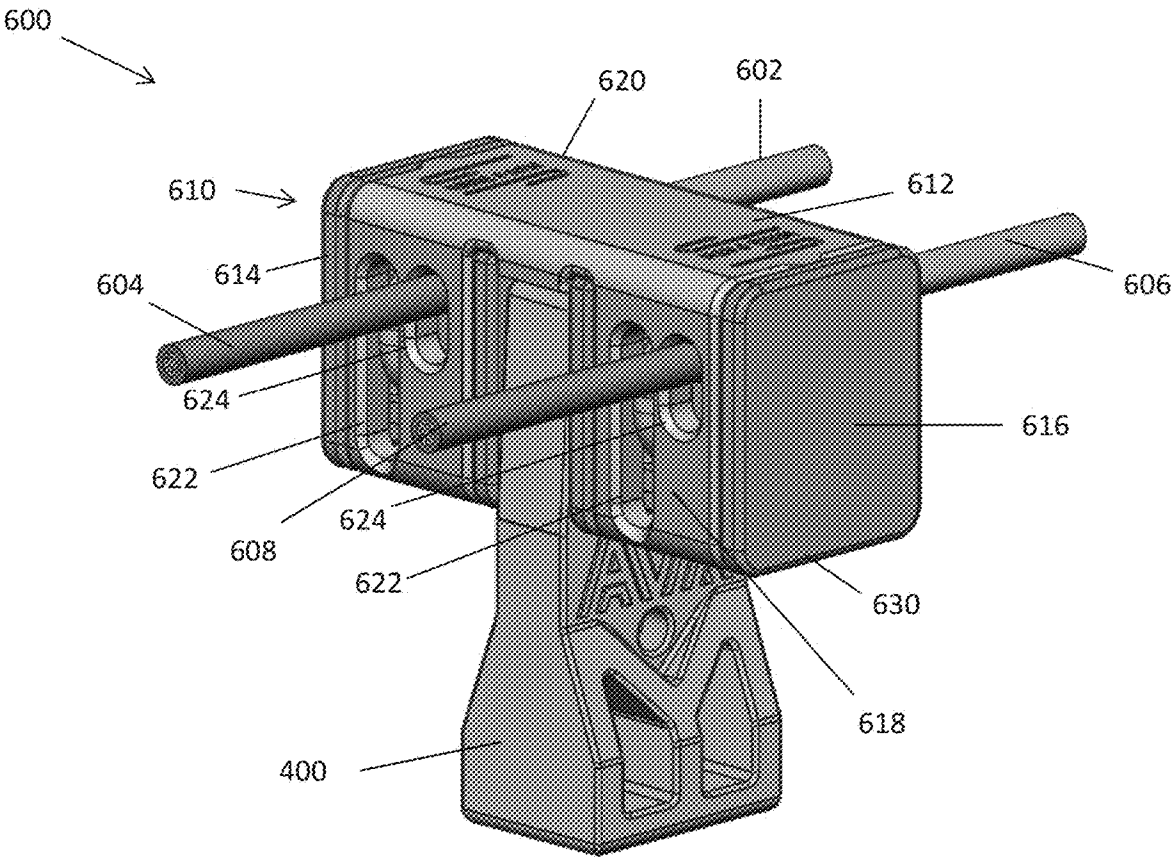
FIG. 6 depicts an isometric view of a wire-to-wire connector in accordance with an illustrative embodiment

FIG. 6 depicts an isometric view of a wire-to-wire connector 600 in accordance with an illustrative embodiment. In the example shown, an insulated housing 610 of the wire-to-wire connector 600 includes a first side wall 614 extending from a base 630, a second side wall 616 extending from the base 630, and a cap 612 covering a plurality of different elements (not depicted) extending from the base 630. The cap 612 extends between the two side walls 614 and 616 and includes a first side surface 618 and a second side surface 620. In the example shown, an outer surface of the cap 612 is substantially flush with circumferential edges of the side walls 614 and 616 such that the wire-to-wire connector 600 has a substantially smooth outer surface.

As shown, the first side surface 618 includes a set of elongated openings 622 and a set of shorter openings 624. Although not depicted, the second side surface 620 also includes sets of elongated and short openings. Wires 604 and 608 extend through the set of shorter openings 624. Although not depicted, the wires 604 and 608 wrap around inner surfaces of the insulated housing 610 (e.g., similar to the wires 106 and 102 described with respect to FIGS. 1*b* and 1*c*), extend through the set of elongated openings on the second side surface 620, and back through the insulated housing 610 such that ends of the wires are covered by portions of the first side surface 618 proximate to the set of shorter openings 624. In other words, portions of the first side surface 618 proximate to (e.g., below) the set of shorter openings 624 serve as wire stops for ends of the wires that extend through the insulated housing 610. Additionally, to facilitate providing clearance for the wires 604 and 608 wrapping around the insulated housing 610, the elongated openings on the second side surface 620 are aligned with the set of shorter openings 624 on the first side surface 618.

Portions of wires 602 and 606 extending through the set of shorter openings on the second side surface 620 wrap around an inner surface of the insulated housing 610. These portions wrapping around the inner surface protrude into the set of elongated openings 622 in the first side surface 618. As such, the unique layout of the insulated housing 610 facilitates the utilization of electrical contacts including pairs of wires by providing clearance to allow the wires to be wrapped around an inner surface of the insulated housing 610.

Figure 7B:
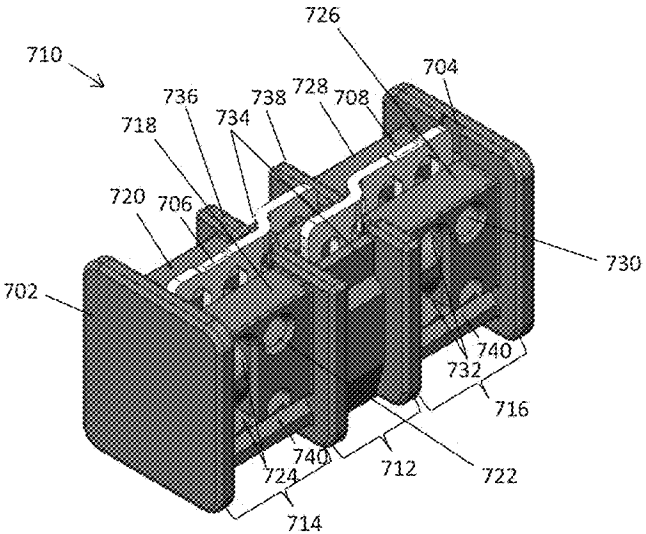
FIG. 7*b* depicts an isometric view of base of an insulated housing of a wire-to-wire connector in accordance with an illustrative embodiment.
Figure 7A:
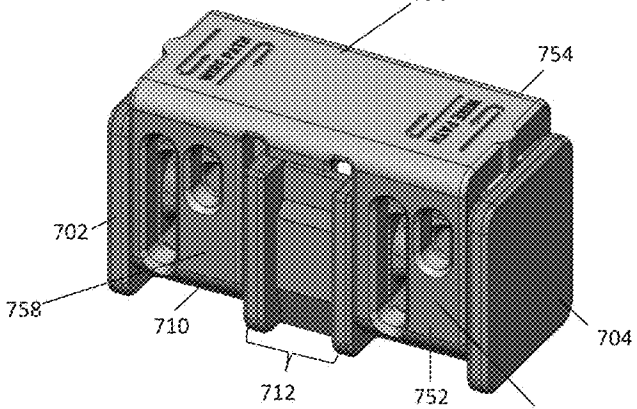
FIG. 7*a* depicts an isometric view of an insulated housing of a wire-to-wire connector in accordance with an illustrative embodiment.
Figure 7C:
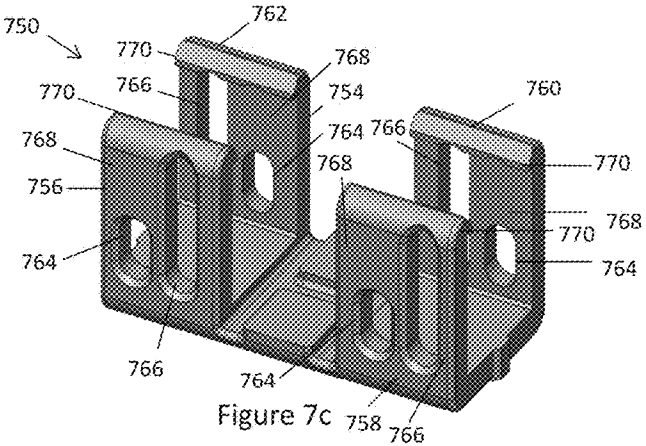
FIG. 7*c* depicts an isometric view of an insulated housing cap of a wire-to-wire connector in accordance with an illustrative embodiment.

Referring generally to FIGS. 7*a*, 7*b*, and 7*c*, isometric views of components of an insulated housing 700 of a wire-to-wire connector are shown in accordance with various illustrative embodiments. FIG. 7*a* depicts an isometric view of the insulated housing 700 in accordance with an illustrative embodiment. FIG. 7*b* depicts an isometric view of a base 710 of the insulated housing 700 in accordance with an illustrative embodiment. FIG. 7*c* depicts an isometric view of cap 750 of the insulated housing 700 in accordance with an illustrative embodiment. In an example embodiment, the insulated housing 700 corresponds to the insulated housing 610 described with respect to FIG. 6.

Referring now to FIG. 7*a*, the insulated housing 700 includes a base 710 and a cap 750. First and second side walls 702 and 704 extend from ends of the base 710. The cap 750 covers a plurality of different elements (not depicted) extending from the base 710. The cap 750 extends between the two side walls 702 and 704 and includes a first side surface 752 and a second side surface 754. The first side surface 752 includes a first wire receiving tab 756 and a second wire receiving tab 758. There is a gap between the first and second wire receiving tabs 756 and 758 configured to receive an electrical shunt receiving portion 712 of the base 710. Although not depicted, the second side surface 734 also includes first and second wire receiving tabs with a gap also configured to receive the shunt receiving portion 712.

Referring now to FIG. 7*b*, the base 710 includes a first wire receiving portion 714 and a second wire receiving portion 716 separated by the shunt receiving portion 712. The first wire receiving portion 714 includes first and second walls 718 and 720 with a gap disposed in between. In the example shown, the first and second walls 718 and 720 are substantially planar and extend perpendicularly to and the entirety of the distance between the first side wall 702 and a wall 736 of the shunt receiving portion 712. The first wall 718 includes a first wire opening 722 disposed proximate to shunt receiving portion 722 and a pair of wire openings 724 disposed proximate to the first side wall 702. The pair of wire openings 724 is disposed in a cavity in the first wall 718. The cavity has a curved outer surface separating the pair of wire openings 724. The curved outer surface supports a wire extending through each wire opening in the pair of wire openings 724. While not depicted, the second wall 720 includes a second wire opening substantially aligned with one of the pair of wire openings 724 in the first wall 718 to facilitate the insertion of a single wire through the first and second walls 718 and 720. Additionally, the second wall 720 also includes an additional pair of wire openings, with one of the pair being aligned with the first wire opening 722 to facilitate the insertion of another wire through the first and second walls 718 and 720.

The gap between the first and second walls 718 and 720 forms an inlet for an electrical contact 706. The electrical contact 706 includes openings that, upon the insertion of the electrical contact 706 in the gap between the first and second walls 718 and 720, align with the wire openings therein to facilitate the formation of electrical connections between the wires and the electrical contact 706 in accordance with the methods described herein.

The second wire receiving portion 716 includes third and fourth walls 726 and 728 with a gap disposed in between. In the example shown, the third and fourth walls 726 and 720 are substantially planar and extend perpendicularly to and the entirety of the distance between the second side wall 704 and a wall 738 of the shunt receiving portion 712. The third wall 726 includes a first wire opening 730 disposed proximate to the second side wall 704 and a pair of wire openings 732 disposed proximate to the shunt receiving portion 712. The pair of wire openings 732 is disposed in a cavity in the third wall 726. The cavity has a curved outer surface separating the pair of wire openings 730. The curved outer surface supports a wire extending through each wire opening in the pair of wire openings 730 and wrapping around the third wall 726. While not depicted, the fourth wall 728 includes a second wire opening substantially aligned with one of the pair of wire openings 730 in the third wall 726 to facilitate the insertion of a single wire through the third and fourth walls 726 and 728. Additionally, the fourth wall 728 also includes an additional pair of wire openings, with one of the pair being aligned with the first wire opening 730 to facilitate the insertion of another wire through the third and fourth walls 726 and 728.

The gap between the third and fourth walls 726 and 728 forms an inlet for an electrical contact 708. The electrical contact 708 includes openings that, upon the insertion of the electrical contact 708 in the gap between the third and fourth walls 726 and 728, align with the wire openings therein to facilitate the formation of electrical connections between the wires and electrical contact 708 in accordance with the methods described herein.

Still referring to FIG. 7*b*, the first, second, third, and fourth walls 718, 720, 726, and 728 include grooves 740. In the example shown, the grooves 740 extend the entirety of the respective distances between the first and second side walls 702 and 704 and the walls 736 and 738 of the shunt receiving portion 712. As described herein, the grooves 740 are configured to receive latching prongs of the cap 750 to facilitate interlocking of the cap 750 and the base 710.

The shunt receiving portion 712 includes outer surfaces 734 shaped in a manner that corresponds to mounting portions (e.g., the latching prongs 420 of the shunt 400 described with respect to FIG. 4) of an electrical shunt to facilitate secure mounting of the electrical shunt to the insulated housing 700. Also as shown, an inner wall is disposed between the outer surfaces 734 such that cavities are formed between the outer surfaces 734 and the inner wall. The cavities are configured to receive portions of the electrical contacts 706 and 708. As shown, the electrical contacts 706 and 708 are bent towards the outer surfaces 734 such that the portions disposed within the cavities are offset with one another to create room for the inner wall. Such a configuration enables the gap between the first and second walls 718 and 720, as well as the gap between the third and fourth walls 726 and 728 to be centered within the base 710. The bends in the electrical contacts 706 and 708 towards the outer surfaces 734 facilitates the electrical contacts 706 and 708 having similar dimensions by preventing overlap in the shunt receiving portion 712. Such similar dimensions simplify the manufacturing process of the wire-to-wire connectors described herein.

Referring now to FIG. 7*c*, an isometric view of the cap 750 of the insulated housing 700 is shown in accordance with an illustrated embodiment. As shown, the cap includes a first wire receiving tab 756, a second wire receiving tab 758, a third wire receiving tab 760, and a fourth wire receiving tab 762. The first and second wire receiving tabs 756 and 758 are separated by a first gap to provide room for the walls 736 and 738 of the shunt receiving portion 712 of the base 710. The third and fourth wire receiving tabs 760 and 762 are also separated by such a gap. As shown in FIG. 7*a*, when the cap 750 is attached to the base 710, inner edges of the first, second, third, and fourth wire receiving tabs 756, 758, 760, and 762 abut the walls 736 and 738 of the shunt receiving portion 712 of the base 710. Additionally inner edges of the first, second, third, and fourth wire receiving tabs 756, 758, 760, and 762 abut the first and second side walls 702 and 704. As such, the cap 750 substantially covers the electrical contacts 706 and 708 to facilitate maintaining electrical connections formed thereby.

In the example shown, each of the first, second, third, and fourth wire receiving tabs 756, 758, 760, and 762 includes a short opening 764 and an elongated opening 766. It should be understood that the cap 750 may include differently configured openings in accordance with various alternative embodiments. In the example shown, the elongated opening 766 of the first wire receiving tab 756 aligns with the short opening 764 of the fourth wire receiving tab 762. The short opening 764 of the first wire receiving tab 756 also aligns with the elongated opening of the fourth wire receiving tab 762. The same relationship holds between the openings in second and third wire receiving tabs 758 and 760. Such a relationship facilitates different wires being inserted into opposing sides of the insulated housing 700. For example, a first wire may be inserted from the side of the first wire receiving tab 756 into the short opening 764 therein, through the base 710, through the elongated opening 766 in the fourth wire receiving tab 762, and back through the base 710 to press against a wire stop portion 768 of the first wire receiving tab 756. A second wire may be inserted from the side of the fourth wire receiving tab 762 into the short opening 764 therein, through the base 710, through the elongated opening 766 in the first wire receiving tab 756, and back through the base 710 to press against a wire stop portion 768 of the fourth wire receiving tab 762. Thus, portions of the first, second, third, and fourth wire receiving tabs 756, 758, 760, and 762 proximate to the short openings 764 serve as wire stops to prevent exposure of ends of wires attached to the insulated housing 700.

As depicted in FIG. 7*a*, when the cap 750 is attached to the base 710, the short and elongated openings 764 and 766 in each of the first, second, third, and fourth wire receiving tabs 756, 758, 760, and 762 align with wire openings contained in the base 710. For example, the short openings 764 of the first and second wire receiving tabs 756 and 758 align with the openings 722 and 730 in the first and third walls 718 and 726 of the base 710 to provide a throughput for a wire. The elongated openings 766 in the first and second wire receiving tabs 756 and 758 align with the pairs of openings 724 and 732 in the first and third walls 718 and 726 to provide clearance for a wire wrapped around surfaces of the first and walls 718 and 726.

Each of the first, second, third, and fourth wire receiving tabs 756, 758, 760, and 762 further include latching prongs 770 at ends thereof. The latching prongs 770 interlock with the grooves 740 in the first, second, third, and fourth walls 718, 720, 726, and 728 of the base 710. That is, upon the cap 750 being pressed onto the base 710, the interlocking between the latching prongs 770 and the grooves 740 prevents the cap 750 and base 710 from coming apart. As such, any electrical contacts (e.g., the electrical contacts 706 and 708) inserted into the base 710 are secured therein due to the stable relationship between the cap 750 and the base 710. For example, an inner surface of the cap 750 may press against edges of the electrical contacts 706 and 708 to ensure that the electrical contacts 706 and 708 remain fully inserted in the base 710 to maintain the electrical connections between the electrical contacts 706 and 708 and any wires inserted therein.

Figure 8:
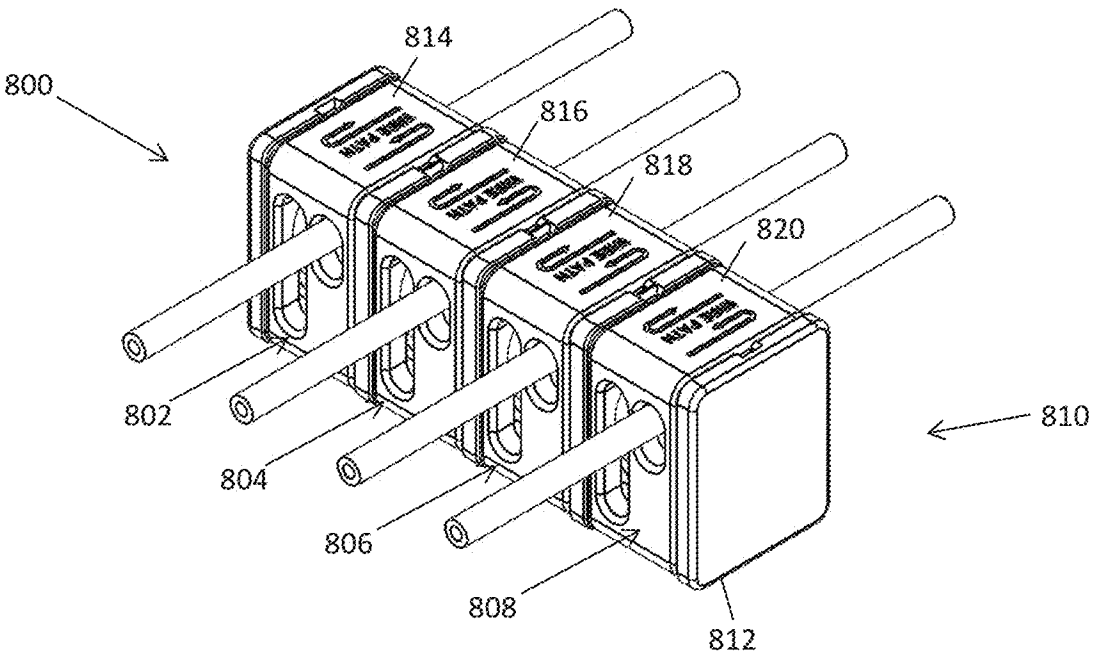
FIG. 8 depicts an isometric view of a wire-to-wire connector with wires installed in accordance with an illustrative embodiment.

FIG. 8 depicts an isometric view of a wire-to-wire connector 800 in accordance with an illustrative embodiment. In an embodiment, the wire-to-wire connector 800 excludes a shunt, which enables the wire-to-wire connector 800 to have a smaller profile than, for example, the wire-to-wire connector 600 described with respect to FIG. 6. The wire-to-wire connector 800 includes four separate electrical contacts (not depicted) inserted into four electrical contact inlets formed in a base 812 of an insulated housing 810. The insulated housing 810 includes four wire holding portions 802, 804, 806, and 808. Each of the wire holding portions 802, 804, 806, and 808 has an associated electrical contact inlet holding one of the electrical contacts. In an embodiment, the electrical contacts are formed between walls similar in structure to the first and second walls 718 and 720 described with respect to FIG. 7*b*. Caps 814, 816, 818, and 820 cover each of the wire holding portions 802, 804, 806, and 808. As shown, each of the caps 814, 816, 818, and 820 includes a pair of wire receiving tabs having openings therein similar. The openings of the wire receiving tabs substantially align with pairs of openings formed in each of the electrical contacts in a manner similar to that described with respect to FIG. 6.

In an embodiment, each of the electrical contacts is similar to electrical contact 230 described with respect to FIG. 2*b*. As such, each electrical contact includes apertures aligned with insulation displacement openings. Wires extend through each aligned pair of apertures and insulation displacement openings. As such, the wire-to-wire connector has eight wires attached thereto. Each pair of wires extending through the same electrical contact is electrically connected to one another. Thus, the wire-to-wire connector 800 enables efficient interconnection between multiple pairs of wires.

Figure 9B:
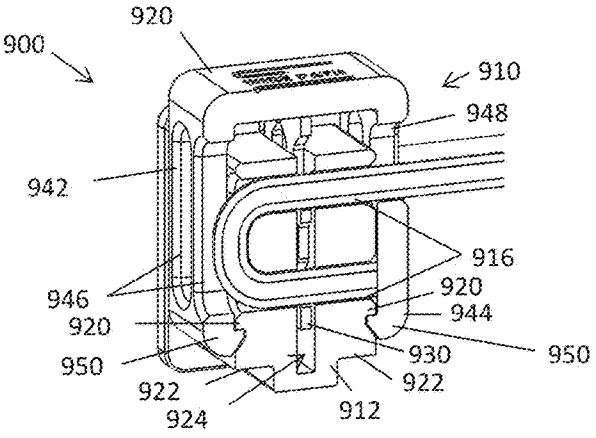
FIGS. 9*b*, 9*c*, and 9*d* depict cross-sectional views of a wire-to-wire connector with wires installed in accordance with an illustrative embodiment.
Figure 9D:
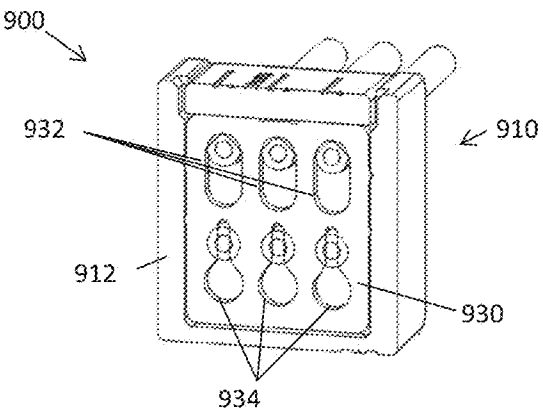
Figure 9A:
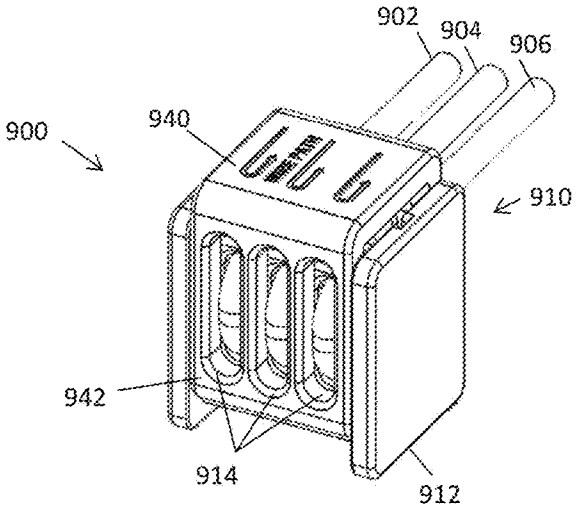
FIG. 9*a* depicts an isometric view of a wire-to-wire connector with wires installed in accordance with an illustrative embodiment.
Figure 9C:
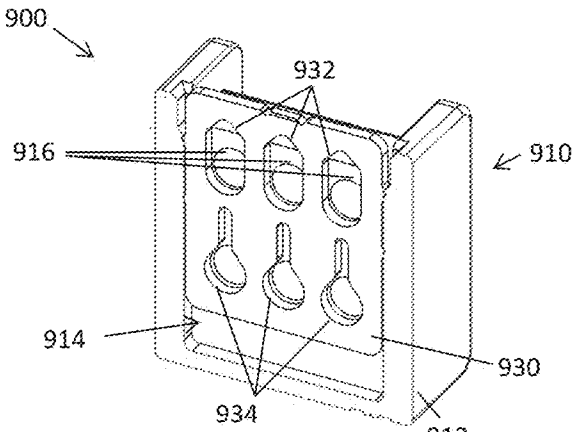

Referring generally to FIGS. 9*a*, 9*b*, 9*c*, and 9*d*, various views of a junction wire-to-wire connector 900 are shown in accordance with an illustrative embodiment. FIG. 9*a* shows an isometric view of the wire-to-wire connector 900 in accordance with an illustrative embodiment. FIG. 9*b* depicts a cross-sectional view of the wire-to-wire connector 900 in accordance with an illustrative embodiment. FIG. 9*c* depicts a cross-sectional view of the wire-to-wire connector 1100 in accordance with an illustrative embodiment. FIG. 9*d* depicts a cross-sectional view of the wire-to-wire connector 900 in accordance with an illustrative embodiment. The wire-to-wire connector 900 includes an insulated housing 910 and an electrical contact 930. A base 912 of the insulated housing 910 includes an electrical contact inlet 914 into which the electrical contact 930 is inserted. A cap 940 interlocks with the base 912 and includes an upper panel having two wire receiving tabs 942 and 944 extending therefrom. The wire receiving tab 942 has three elongated openings 946 disposed therein. The wire receiving tab 944 has three shorter openings 948. In the example shown, upper edges of the shorter openings 948 are aligned with upper edges of the elongated openings 946 such that the wire receiving tab 944 includes a solid portion that is aligned with portions of the elongated openings 946. The solid portion serves as a wire stop for wires 912, 904, and 906 inserted through the openings 916 in the base 912 and wrapped around an internal surface of the base 912 disposed proximate to the elongated openings 946. The elongated openings 946 provide clearance for wires to be wrapped around the internal surface of the base 912 and re-inserted through one of the openings 916.

As depicted in FIG. 9*a*, the wires 902, 904, and 906 extend from a single side of the wire-to-wire connector 900. In the configuration shown in FIG. 9*a*, the electrical contact 930 is only partially inserted into the electrical contact inlet 914. As shown by the cross-sectional view depicted by FIG. 9*c*, in such a configuration, openings 916 in the base 912 are aligned with lower regions of apertures 932 of the electrical contact 930, thus providing passage for wires 902, 904, and 906 to be inserted through the insulated housing 910 and the electrical contact 930. Additional openings 916 in the base 912 are aligned with wider regions of insulation displacement openings 934 in the electrical contact 930, thus providing clear passage for the entirety of the wires 902, 904, and 906 (e.g., a combination of a conductive core and outer insulating layer) to be re-inserted through the additional openings 916 and wrapped around a curved inner surface of the base 912. Additionally, both the insulation displacement openings 934 and the apertures 932 extend above the passages through which the wires 902, 904, and 906 are inserted, thus providing freedom of relative motion between the wires 902, 904, and 906 and the electrical contact 130 to facilitate the complete insertion of the electrical contact 930 into the electrical contact inlet 914.

As depicted in FIG. 9*d*, when the electrical contact 930 is completely inserted in the electrical contact inlet 914, a lower edge of the electrical contact 930 abuts a lower surface defining a boundary of the electrical contact inlet 914. The insulated housing 910 and electrical contact 930 are dimensioned such that, during a process of pressing the electrical contact 930 further into the electrical contact inlet 914, narrow regions of the insulation displacement openings 934 slide against outer insulating layers of the wires 902, 904, and 906. In an embodiment, the narrow regions are of a width that is than diameters of the wires 902, 904, and 906 such that edges of the narrow regions slice the outer insulating layers to create contact areas between the electrical contact 930 and the wires 902, 904, and 906. Additionally, once the electrical contact 930 is completely inserted into the electrical contact inlet 914, upper edges of the apertures 932 press against the outer insulating layers of the wires 902, 904, and 906. In an embodiment, the upper edges of the apertures 932 press the wires 902, 904, and 906 against lower surfaces defining the openings 916 to relieve stress from the contact areas established via the insulation displacement openings 934.

As depicted in FIG. 9*b*, the base 912 includes grooves 920 extending on either side thereof. When the electrical contact 930 is only partially inserted into the electrical contact inlet 914, latching prongs 950 at ends of the wire receiving tabs 942 and 944 of the cap 940 engage with the grooves 920 to maintain the relative positioning between the electrical contact 930 and the base 912 described with respect to FIG. 9*c*. The base 912 further includes ledges 922 extending inward towards the electrical contact inlet 914. In an embodiment, when the electrical contact 930 is fully inserted electrical contact inlet 914, the latching prongs 950 engage with the ledges 922 to secure and maintain the relative positioning between the electrical contact 930 and the base 912 described with respect to FIG. 9*d*. As such, the relative dimensions of the base 912, cap 940, and electrical contact 930 are specifically chosen to maximize the stability of the electrical connections formed via the methods described herein.

FIG. 10*a* depicts an isometric view of an electrical contact 1000 in accordance with an illustrative embodiment. The electrical contact 1000 includes a wire receiving portion 1002 and a male connection prong 1004. The wire receiving portion includes an aperture 1006 as well as an insulation displacement opening 1008. In an embodiment, the opening 1006 and insulation displacement opening 1008 are similar in structure to the apertures 932 and insulation displacement openings 934 described with respect to FIG. 9*c*. The male connection prong 1004 extends from the wire receiving portion 1002 and includes a tapered end to facilitate its insertion to a corresponding female connection socket.

FIG. 10*b* depicts an isometric view of an electrical contact 1010 in accordance with an illustrative embodiment. In the example depicted, the electrical contact 1010 includes the wire receiving portion 1002 described with respect to FIG. 10*a*. Instead of the male connection prong 1004, however, the electrical contact 1010 includes a female connection socket 1012 constructed from a pair of contact tines having ridges at ends thereof. In various embodiments, the ridges of the contact tines are spaced apart less than a dimension of a corresponding male connector (e.g., the male connection prong 1004 of an electrical contact of another wire-to-wire connector), such that contact tines maintain a connection with the corresponding male connector. As depicted, the contact tines are co-planar with the wire-receiving portion 1002.

FIG. 10*c* depicts an isometric view of an electrical contact 1014 in accordance with an illustrative embodiment. In the example depicted, the electrical contact 1014 includes the wire receiving portion 1002 described with respect to FIG. 10*a*. Instead of the male connection prong 1004, however, the electrical contact 1014 includes a female connection socket 1016 constructed from a pair of contact tines having ridges at ends thereof. The female connection socket 1016 includes a pair of contact tines. However, unlike the female connection socket 1012 described with respect to FIG. 10*b*, the contact tines of the female connection socket 1016 include planar surfaces that extend substantially perpendicular to the wire receiving portion 1002. The planar surfaces increase the contact area between the female connection socket 1016 and a corresponding male connector to enhance the stability of a mechanical connection.

FIG. 10*d* depicts an isometric view of an electrical contact 1018 in accordance with an illustrative embodiment. In the example depicted, the electrical contact 1018 includes the wire receiving portion 1002 described with respect to FIG. 10*a*. Instead of the male connection prong 1004, however, the electrical contact 1018 includes a female connection socket 1020 constructed from a pair of contact tines having ridges at ends thereof. The female connection socket 1020 includes a pair of contact tines. However, unlike the female connection socket 1016 described with respect to FIG. 10*c*, the contact tines of the female connection socket 1020 include planar surfaces that extend substantially parallel to the wire receiving portion 1002. In other words, a first one of the contact tines is substantial co-planar to the wire-receiving portion 1002 and a second one of the contact tines is offset from the first one in a direction perpendicular to the wire receiving portion 1002. Thus, by changing the relative orientation between female connection sockets and the wire receiving portions, connections with differently oriented male connectors may be made. It should be understood that the male connection prong 1004 depicted in FIG. 10*a* may be rotated with respect to the wire receiving portion 1002 by any angle to facilitate connections with differently-oriented female connectors.

Figure 11A:
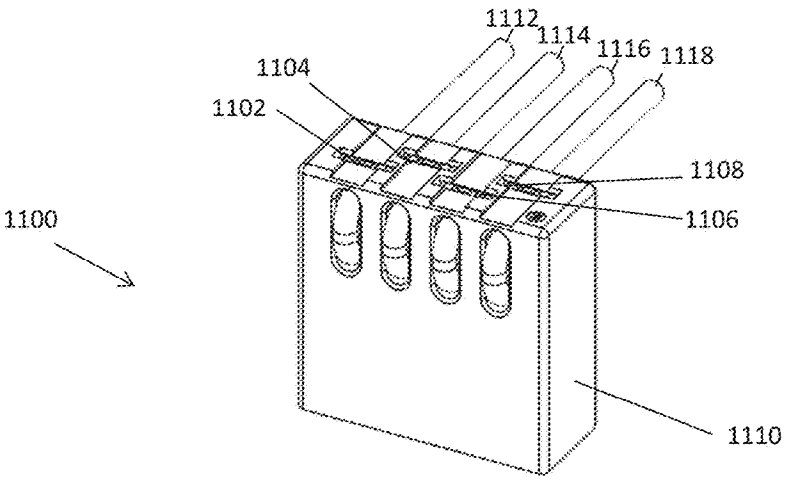
FIGS. 11*a* and 11*b* depict isometric views of wire-to-wire connectors in accordance with various illustrative embodiments.

FIG. 11*a* depicts an isometric view of a wire-to-wire connector 1100. The wire-to-wire connector 1100 includes an insulated housing 1110 including four electrical contact inlets. The electrical contact inlets have electrical contacts 1102, 1104, 1106, and 1108 disposed therein. In various embodiments, the electrical contacts 1102, 1104, 1106, and 1108 are substantially similar to the electrical contact 1000 described above with respect to FIG. 10*a*. In one embodiment, adjacent electrical contact inlets are offset from one another in an alternating pattern to facilitate a compact design of the insulated housing 1110. As described herein, the electrical contact inlets are disposed between walls in the insulated housing 1110 including openings therein to facilitate the insertion of wires 1112, 1114, 1116, and 1118 therein. For example, on one embodiment, the walls surrounding each of the electrical contact inlets are of a similar structure to the first and second walls 718 and 720 described with respect to FIG. 7*b*. As such, the wires 1112, 1114, 1116, and 1118 wrap around a curved surface to extend through pairs of openings disposed in the walls in a manner similar to that described with respect to FIG. 9*b*.

In various embodiments, the insulated housing 1110 includes a cavity disposed beneath the wires 1112, 1114, 1116, and 1118. The cavity is configured to receive a portion of another insulated housing (e.g., of a female wire-to-wire connector). Male connection prongs 1004 of the electrical contacts 1102, 1104, 1106, and 1108 extend into the cavity such that they are engageable with female connection sockets (e.g., the female connection sockets 1020 described with respect to FIG. 10*d*) of the female wire-to-wire connector.

Figure 11B:
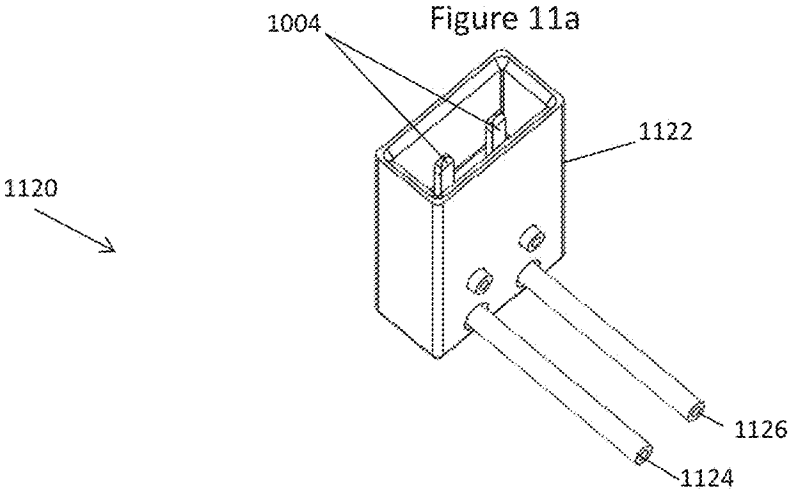

FIG. 11*b* depicts an isometric view of a wire-to-wire connector 1120. In various embodiments, the wire-to-wire connector 1120 is similar in structure to the wire-to-wire connector 1100 described with respect to FIG. 11*a*, except that an insulating housing 1122 thereof includes only two electrical contact inlets. As such, only two wires 1124 and 1126 are held via the wire-to-wire connector 1120. As shown, male connection prongs 1004 extend into a cavity defined by the insulated housing 1110. In various embodiments, caps are disposed over the insulated housings 1110 and 1122 to cover various opening therein.

Figure 12A:
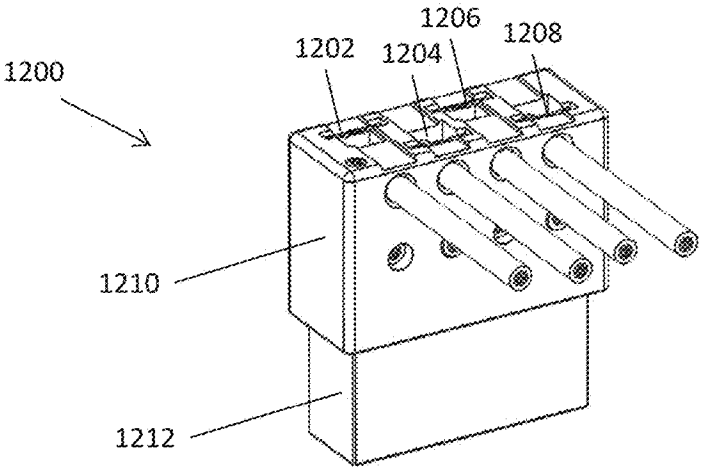
FIGS. 12*a* and 12*b* depict isometric views of wire-to-wire connectors in accordance with various illustrative embodiments.

FIG. 12*a* depicts an isometric view of a wire-to-wire connector 1200. The wire-to-wire connector 1200 includes an insulated housing 1210 including four electrical contact inlets. The electrical contact inlets have electrical contacts 1202, 1204, 1206, and 1208 disposed therein. In various embodiments, the electrical contacts 1202, 1204, 1106, and 1208 are substantially similar to the electrical contact 1014 described above with respect to FIG. 10*c*. In one embodiment, adjacent electrical contact inlets are offset from one another in an alternating pattern to facilitate a compact design of the insulated housing 1210. As described herein, the electrical contact inlets are disposed between walls in the insulated housing 1210 including openings therein to facilitate the insertion of wires therein. For example, on one embodiment, the walls surrounding each of the electrical contact inlets are of a similar structure to the first and second walls 718 and 720 described with respect to FIG. 7*b*. As such, the wires wrap around a curved surface to extend through pairs of openings disposed in the walls in a manner similar to that described with respect to FIG. 9*b*.

In various embodiments, the insulated housing 1210 includes an extending portion 1212 having a smaller cross sectional area than the remainder of the insulated housing 1210. The extending portion 1212 includes an outer surface shaped to conform to a surface of a corresponding male wire-to-wire connector 1200 (e.g., the cavity defined by the insulated housing 1110 of the wire-to-wire connector 1100 described with respect to FIG. 11*a*). In various embodiments, the extending portion 1212 includes openings through which female connection sockets 1016 pass. Additionally, the openings provide an inlet for male contact prongs of a corresponding male connector.

Figure 12B:
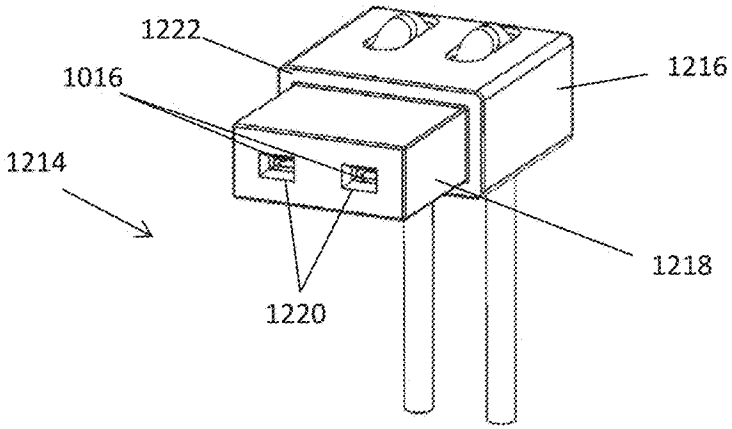

FIG. 12*b* depicts an isometric view of a wire-to-wire connector 1214. In various embodiments, the wire-to-wire connector 1214 is similar in structure to the wire-to-wire connector 1200 described with respect to FIG. 12*a*, except that an insulating housing 1216 thereof includes only two electrical contact inlets. As such, only two wires are held via the wire-to-wire connector 1214. As shown, openings 1220 in an extending portion 1218 of the insulated housing 1216 receive female connection sockets 1016 of the electrical contacts. A difference in cross-sectional area between the extending portion 1218 and the remainder of the insulated housing 1216 creates a ledge 1222 at the boundary between the extending portion 1218 and the remainder. In various embodiments, the extending portion 1218 is of a dimension that corresponds with the cavity defined by the insulated housing 1122 of the wire-to-wire connector 1120 described with respect to 11*b*. As such, the extending portion 1218 is inserted into the cavity such that male contact prongs 1004 are inserted into the female connection sockets 1016 via the openings 1220 to create electrical connections between wires inserted into each one of the wire-to-wire connectors 1120 and 1214.

Figure 13:
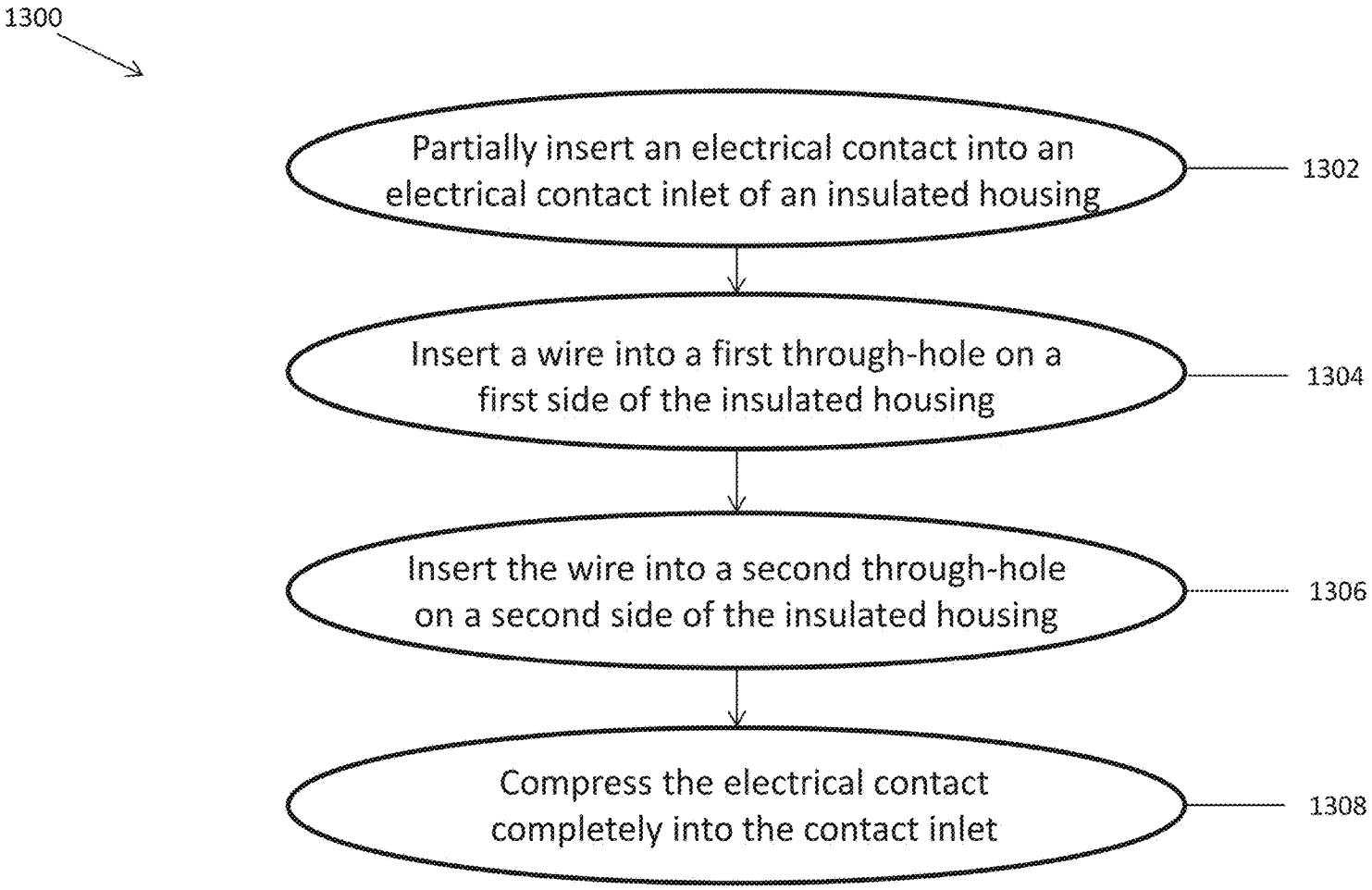
FIG. 13 depicts a method of use of a wire-to-wire connector in accordance with an illustrative embodiment.

FIG. 13 depicts a method 1300 of use of a wire-to-wire connector in accordance with an illustrative embodiment. In an operation 1302, an electrical contact is partially inserted into a first electrical contact inlet of an insulated housing. That is the electrical contact is placed in a contact inlet such that a first wire aperture of the electrical contact is aligned with one of the through-holes of the insulated housing and the other through-hole is unobstructed by the first electrical contact. The operation 1302 may be repeated any number of times depending on how many electrical contacts are to be inserted into the insulated housing.

In an operation 1304, a wire is inserted and extended through a first through-hole on a first side of the insulated housing such that the wire is received on a second side of the insulated housing. Additionally, the first wire extends through a first wire aperture of the electrical contact. The operation 1304 may be repeated any number of times depending on how many apertures are included in the electrical contact and how many electrical contacts are inserted into the insulated housing.

In an operation 1306, the wire is extended through the second through-hole on the second side of the insulated housing such that the wire is received back on the first side of the insulated housing. At this point, both ends of the wire are extending on the first side of the insulated housing (i.e., the wire is wrapped around a partition of the insulated housing). The operation 1306 may be repeated depending on a number of wires inserted into the insulated housing. In an operation 1308, the electrical contact is compressed completely into the electrical contact inlet such that the electrical contact is flush with a surface of the electrical contact inlet. The compression of the electrical contact causes a narrow portion of an insulation displacement opening in the first electrical contact to displace insulation on the wire to create an electrical connection and first point of contact between the electrical contact and the wire. Further, the compression of the electrical contact causes the first wire aperture to compress (i.e., pinch) insulation of the first wire to create a second point of contact between the electrical contact and the wire.

Figure 14:
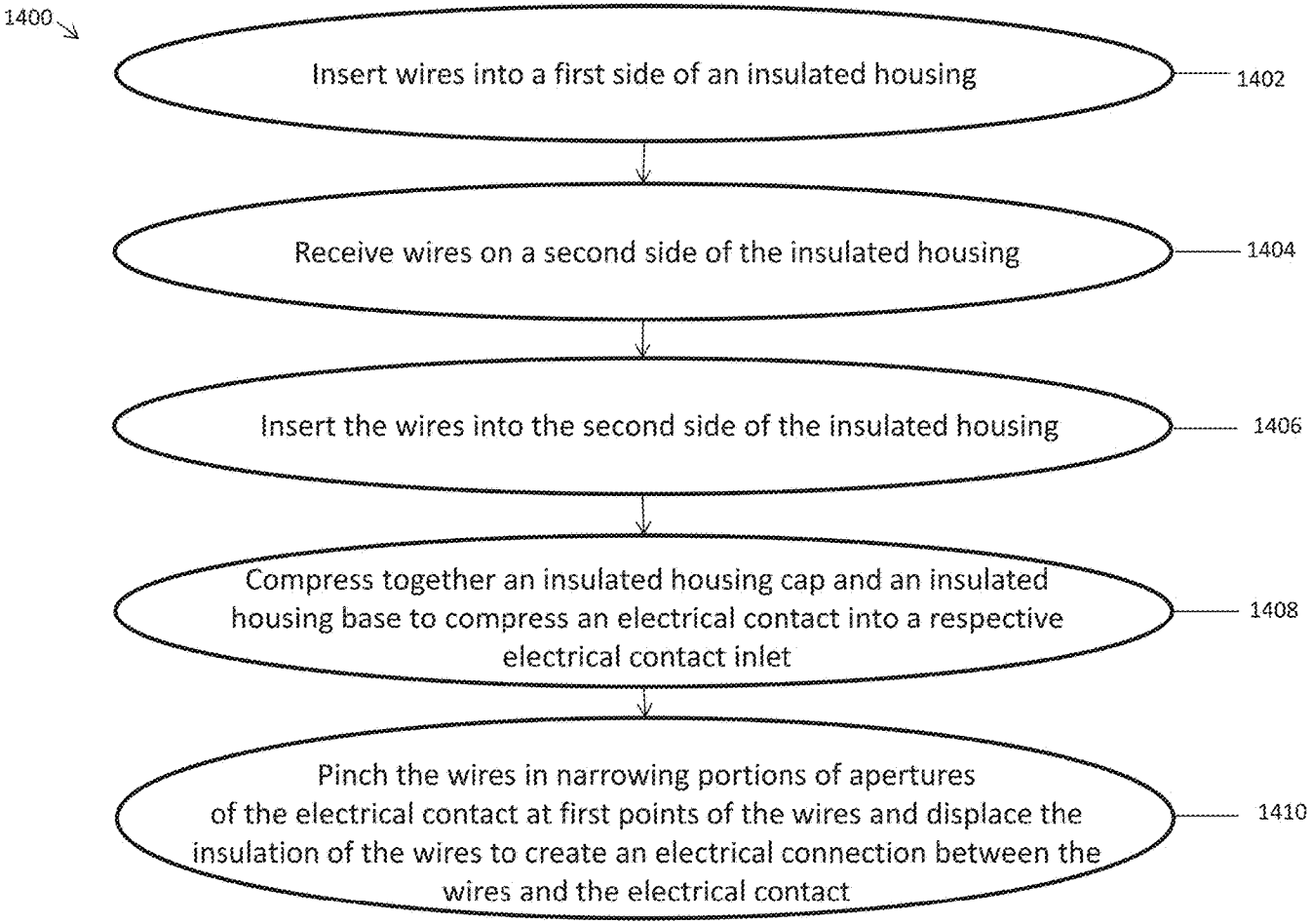
FIG. 14 depicts a method of use of a wire-to-wire connector in accordance with an illustrative embodiment.

FIG. 14 depicts a method of use 1400 of a wire-to-wire connector in accordance with an illustrative embodiment. In an operation 1402, a wire or wires inserted into a first side of an insulated housing. In one embodiment, the wires are inserted into shorter openings of an insulated housing cap and into first through holes of pairs of through holes in an insulated housing base. In one embodiment, the insulated housing cap has an electrical contact affixed thereto and the electrical contact is partially inserted into an electrical contact inlet in the insulated housing base (e.g., as shown in FIGS. 9*a*, 9*b*, and 9*c*).

In an operation 1404, the wires are received on a second side of the insulated housing. Specifically, the wires are on the other side of the first through-holes and through elongated openings of the insulated housing cap. In an operation 1406, the wires are inserted into the second side of the insulated housing. More particularly, wires inserted into second through holes of the pairs of through holes in the insulated housing base. In other words, the wires are being wrapped around inner surfaces (e.g., curved inner surfaces) of the insulated housing base. In an embodiment, ends of the wires do not protrude from the insulated housing. That is, ends of the wires that are inserted into the second through-holes of the insulated housing base are stopped on the other side of the insulated housing base by wire stop portions of the insulated housing cap.

In an operation 1408, the insulated housing cap and the insulated housing base are compressed completely together such that the cap ledges of the insulted housing cap are pushed over the ledges of the insulated housing base. In that way, the insulated housing cap and the insulated housing base are mechanically secured together. The compression of the insulated housing base and insulated housing cap together causes the electrical contact to be completely compressed into the electrical contact inlet.

In an operation 1410, the insulation of the wires is pinched in narrowing portions of apertures in the electrical contact aligned with the first through holes. Additionally insulation displacement openings in the electrical contact displace insulation of the wires and create electrical connections between the wires and the electrical contact. In an embodiment, only a single wire is inserted into a single electrical contact. As such, any of the operations 1402, 1404, 1406, 1408, and 1410 may be performed any number of times to facilitate the insertion of different wires into different electrical contacts.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. An apparatus comprising:

a first electrical contact comprising a first wire receiving portion, the first wire receiving portion comprising a first insulation displacement connection (IDC) slot and a first strain relief slot displaced from the first IDC slot;

a second electrical contact comprising a second wire receiving portion, the second wire receiving portion comprising a second IDC slot and a second strain relief slot displaced from the second IDC slot;

an insulated housing comprising a first electrical contact inlet, a second electrical contact inlet, a first plurality of wire openings, and a second plurality of wire openings.

2. The apparatus of claim 1, further comprising an electrical shunt, wherein the electrical shunt comprises a male contact prong configured to be received within a shunt opening of the insulated housing, the shunt opening being disposed between the first and second electrical contact inlets, wherein the first electrical contact further comprising a first shunt connector portion, wherein the second electrical contact further comprising a second shunt connector portion.

3. The apparatus of claim 2, wherein the first shunt connector portion and the second shunt connector portion each comprise respective female contact sockets, and wherein each of the respective female contact sockets is configured to receive and form an electrically-conductive connection with the male contact prong.

4. The apparatus of claim 1, wherein the first and second IDC slots are substantially Y-shaped and extend from outer edges of the first and second wire receiving portions so as to form tapered distal end portions at the outer edges.

5. The apparatus of claim 1, wherein the first and second strain relief slots include distal portions and proximal portions, wherein the proximal portions are of a first average width and the distal portions are of a second average width, the first average width being less than the second average width.

6. The apparatus of claim 1, wherein the first electrical contact further comprises a third wire receiving portion and the second electrical contact further comprises a fourth wire receiving portion, the third wire receiving portion including a third IDC slot and a third strain relief slot, the fourth wire receiving portion including a fourth IDC slot and a fourth strain relief slot.

7. The apparatus of claim 1, wherein the insulated housing includes a plurality of curved surfaces disposed between the first plurality of wire openings and the second plurality of wire openings.

8. An apparatus comprising:

a first electrical contact comprising a first aperture and a first insulation displacement opening, wherein centers of the first aperture and the first insulation displacement opening are aligned; and an insulated housing comprising a first wire opening, a second wire opening, and a first electrical contact inlet extending through the first and second wire openings, wherein the first electrical contact is at least partially inserted into the first electrical contact inlet such that at least a portion of the first aperture is aligned with the first wire opening.

9. The apparatus of claim 8, wherein the electrical contact is completely inserted into the electrical contact inlet such that a narrow portion of the first insulation displacement opening is aligned with the second wire opening.

10. The apparatus of claim 9, wherein the insulated housing further includes a base and a cap disposed over an outer surface of the base, wherein the outer surface comprises a curved portion on a first side of the insulated housing extending between the first and second wire openings.

11. The apparatus of claim 10, wherein the cap includes an elongated opening on the first side and a shorter opening on a second side of the insulated housing, wherein ends of the elongated opening are substantially aligned with outer edges of the first and second wire openings such that the elongated opening extends over the first and second wire openings.

12. The apparatus of claim 11, wherein the cap includes a first wire receiving tab and a second wire receiving tab extending from a surface, the first wire receiving tab on the first side and the second wire receiving tab on the second side, wherein the first and second wire receiving tabs include latching prongs that are interlocked with ridges in the base.

13. The apparatus of claim 8, wherein the electrical contact further comprises a plurality of additional apertures and a plurality of additional insulation displacement openings, wherein the insulated housing further comprises plurality of additional wire openings, wherein the first electrical contact inlet extends through the plurality of additional wire openings, wherein a set of the plurality of additional wire openings are at least aligned with portions of the plurality of additional apertures.

14. The apparatus of claim 8, further comprising a second electrical contact comprising a second aperture and a second insulation displacement opening, wherein the insulated housing further comprises a third wire opening, a fourth wire opening, and a second electrical contact inlet extending through the third and fourth wire openings, wherein the second electrical contact is at least partially inserted into the second electrical contact inlet such that a portion of the second aperture is aligned with the third wire opening.

15. The apparatus of claim 14, wherein the first and second electrical contact inlets are disposed on opposing sides of a central axis of the insulated housing.

16. The apparatus of claim 15, wherein the first insulation displacement opening is substantially Y-shaped and includes a wider portion extending from an edge of the first electrical contact.

17. The apparatus of claim 15, wherein the first aperture and the first wire displacement opening are disposed on a wire receiving portion of the first electrical contact, wherein the first electrical contact further comprises a female connection socket extending from an edge of the wire receiving portion, the female connection socket including contact tines with ridges at ends thereof.

18. A method comprising:

partially inserting an electrical contact into an inlet of an insulated housing;

inserting a first wire into a first through-hole on a first side of the insulated housing;

inserting the first wire into a second through-hole on the second side of the insulated housing, the second through-hole displaced from the first through-hole in a direction perpendicular to a direction of extension of the first through-hole; and compressing the electrical contact into the inlet such that a narrow portion of an insulation displacement opening of the electrical contact displaces removes insulation on the first wire to create an electrical connection between the electrical contact and the first wire and an aperture of the electrical contact compresses insulation of the first wire to create a point of contact between the electrical contact and the first wire.

19. The method of claim 18, further comprising, after inserting the first wire into the first through-hole but prior to compressing the electrical contact into the inlet, wrapping the first wire around an inner surface of the insulated housing so as direct an end of the first wire into the second through-hole.

20. The method of claim 18, further comprising, prior to compressing the electrical contact into the inlet:

inserting a second wire into a third through-hole on the first side of the insulated housing; and inserting the second wire into a fourth through-hole on the second side of the insulated housing.

21. The method of claim 18, wherein the inlet is a first inlet and the electrical contact is a first electrical contact, further comprising:

partially inserting a second electrical contact into a second inlet of the insulated housing;

inserting a second wire into a third through-hole on the first side of the insulated housing;

inserting the second wire into a fourth through-hole on the second side of the insulated housing; and compressing the second electrical contact completely into the second inlet such an edge of an insulation displacement opening of the second electrical contact displaces insulation on the second wire to create an electrical connection between the second electrical contact and the second wire, and an aperture of the second electrical contact compresses insulation of the second wire to create a point of contact between the second electrical contact and the second wire.

22. The method of claim 21, further comprising:

inserting a male contact prong into a shunt opening of the insulated housing such that the male contact prong engages a first shunt connector portion of the first electrical contact and a second shunt connector portion of the second electrical contact to conductively couple the first electrical contact to the second electrical contact.

23. The method of claim 22, further comprising removing the male contact prong from the shunt opening of the insulated housing such that the male contact prong disengages the first shunt connector portion of the first electrical contact and the second shunt connector portion of the second electrical contact to conductively decouple the first electrical contact from the second electrical contact.

* * * * *